US012781520B2

(12) United States Patent
Halonen et al.

(10) Patent No.: US 12,781,520 B2
(45) Date of Patent: Nov. 3, 2026

(54) CONCRETE SCREEDING MACHINE WITH WALL EDGE SCREEDING FEATURE

(71) Applicant: Somero Enterprises, Inc., Ft. Myers, FL (US)

(72) Inventors: Philip D. Halonen, Calumet, MI (US); Grant A. Johnson, Hancock, MI (US); Mark A. Pietila, Atlantic Mine, MI (US)

(73) Assignee: Somero Enterprises, Inc., Ft. Myers, FL (US)

( * ) Notice: Subject to any disclaimer, the term of this patent is extended or adjusted under 35 U.S.C. 154(b) by 777 days.

(21) Appl. No.: 18/167,114

(22) Filed: Feb. 10, 2023

(65) Prior Publication Data

US 2023/0258005 A1 Aug. 17, 2023

Related U.S. Application Data

(60) Provisional application No. 63/370,116, filed on Aug. 2, 2022, provisional application No. 63/267,951, filed on Feb. 14, 2022.

(51) Int. Cl.
*E04F 21/24* (2006.01)
*E01C 19/40* (2006.01)

(52) U.S. Cl.
CPC ..... *E04F 21/242* (2013.01); *E01C 19/40* (2013.01)

(58) Field of Classification Search
CPC ..... E01C 19/40; E01C 19/006; E01C 19/402; E01C 19/405; E04G 21/10; E04F 21/242; E04F 21/244
See application file for complete search history.

(56) References Cited

U.S. PATENT DOCUMENTS 3,914,064 A 10/1975 Gurries
4,197,032 A 4/1980 Miller
(Continued)

FOREIGN PATENT DOCUMENTS

CN 105442417 A 3/2016
WO 2006133490 A1 12/2006

OTHER PUBLICATIONS

International Search Report and Written Opinion dated Jul. 26, 2023 for corresponding PCT Application No. PCT/US2023/062335.
(Continued)

*Primary Examiner* — Abigail A Risic
(74) *Attorney, Agent, or Firm* — HONIGMAN LLP

(57) ABSTRACT

A screeding machine for screeding uncured concrete includes a base unit, a support mechanism disposed at an end portion of the base unit, and a screed head assembly supported at the support mechanism. The screed head assembly includes (i) a grade establishing member and (ii) a vibrating member. The support mechanism includes a lateral actuator that operates to laterally shift the screed head assembly relative to the base unit in a direction orthogonal to a longitudinal axis of the base unit. A control system is operable to control the lateral actuator to laterally shift the screed head assembly in the direction orthogonal to the longitudinal axis of the base unit to move the screed head assembly toward a wall or structure while the screeding machine moves over uncured concrete in a screeding direction via movement of the base unit along the uncured concrete and alongside the wall or structure.

27 Claims, 21 Drawing Sheets

(56) References Cited

U.S. PATENT DOCUMENTS

| | | | | |
|---|---|---|---|---|
| 4,655,633 | A | 4/1987 | Somero et al. | |
| 4,930,935 | A | 6/1990 | Quenzi et al. | |
| 5,129,803 | A | 7/1992 | Nomura et al. | |
| 5,752,783 | A | 5/1998 | Malone | |
| 6,129,481 | A * | 10/2000 | Tapio | E04G 21/10 404/102 |
| 6,227,761 | B1 | 5/2001 | Kieranen et al. | |
| 6,976,805 | B2 | 12/2005 | Quenzi et al. | |
| 7,044,681 | B2 | 5/2006 | Quenzi et al. | |
| 7,121,762 | B2 | 10/2006 | Quenzi et al. | |
| 7,175,363 | B2 | 2/2007 | Quenzi et al. | |
| 7,195,423 | B2 | 3/2007 | Halonen et al. | |
| 7,396,186 | B2 | 7/2008 | Quenzi et al. | |
| 7,850,396 | B2 | 12/2010 | Pietila et al. | |
| 7,854,565 | B2 | 12/2010 | Halonen et al. | |
| 8,038,366 | B2 | 10/2011 | Halonen et al. | |
| 9,835,610 | B2 | 12/2017 | Kangas | |
| 10,190,268 | B2 | 1/2019 | Pietila et al. | |
| 10,895,045 | B2 | 1/2021 | Kangas | |
| 2004/0086337 | A1 | 5/2004 | Zachman et al. | |
| 2007/0116520 | A1 | 5/2007 | Quenzi et al. | |
| 2007/0127985 | A1 | 6/2007 | Halonen et al. | |
| 2008/0131205 | A1 * | 6/2008 | Quenzi | E01C 19/006 404/114 |
| 2009/0175681 | A1 | 7/2009 | Pietila et al. | |
| 2010/0196096 | A1 | 8/2010 | Halonen et al. | |
| 2018/0088102 | A1 | 3/2018 | Kangas | |
| 2018/0327982 | A1 | 11/2018 | Leukuma et al. | |
| 2022/0064971 | A1 | 3/2022 | Halonen et al. | |
| 2022/0316154 | A1 | 10/2022 | Johnson et al. | |

OTHER PUBLICATIONS

Extended European Search Report dated Jan. 20, 2026 from corresponding European Patent Application No. 23753678.4.

* cited by examiner

CONCRETE SCREEDING MACHINE WITH WALL EDGE SCREEDING FEATURE

CROSS REFERENCE TO RELATED APPLICATIONS

The present application claims the filing benefits of U.S. provisional application Ser. No. 63/370,116, filed Aug. 2, 2022, and U.S. provisional application Ser. No. 63/267,951, filed Feb. 14, 2022, which are hereby incorporated herein by reference in their entireties.

FIELD OF THE INVENTION

The present invention relates generally to an apparatus and method for screeding freshly poured concrete that has been placed over a support surface.

BACKGROUND OF THE INVENTION

Screeding devices or machines are used to level and smooth uncured concrete to a desired grade. Known screeding machines typically include a screed head, which includes a vibrating member and a grade setting device, such as a plow and/or an auger device. Such screeding machines are used to smooth and screed concrete placed over a horizontal support surface, such as a floor of a building or structure. In some situations, the screeding device or vibrating member may float on the concrete surface or may rest or float on form boards along the edge of the concrete slab being formed.

SUMMARY OF THE INVENTION

A screeding machine is operable to screed concrete that is placed at a support surface and along walls or other structure at or adjacent to the support surface (the concrete may be placed and screeded at the support surface within and defined by form boards or framework or may be placed and screeded over the form boards along the wall or structure). The screeding machine includes a base unit (such as a wheeled base unit) and a screed head that is raisable and lowerable relative to the base unit via elevation cylinders or actuators. The screeding machine includes a lateral actuator that shifts the screed head laterally relative to a longitudinal axis of the screeding machine. The lateral actuator urges the screed head toward the wall or structure so that the screed head maintains its position against or proximate to the wall or structure as the screeding machine moves along the wall or structure. Thus, as the screeding machine is moved along the wall or structure, the screed head screeds the concrete surface (responsive to signals from the sensors, such as laser receivers or other suitable sensors that are used to determine the position of the screed head, of the elevation cylinders) close to or at the wall or structure irrespective of whether or not the wheeled base unit wavers in its course along the wall or structure and moves away from (or toward) the wall or structure.

These and other objects, advantages, purposes and features of the present invention will become apparent upon review of the following specification in conjunction with the drawings.

DESCRIPTION OF THE PREFERRED EMBODIMENTS

Figure 1:
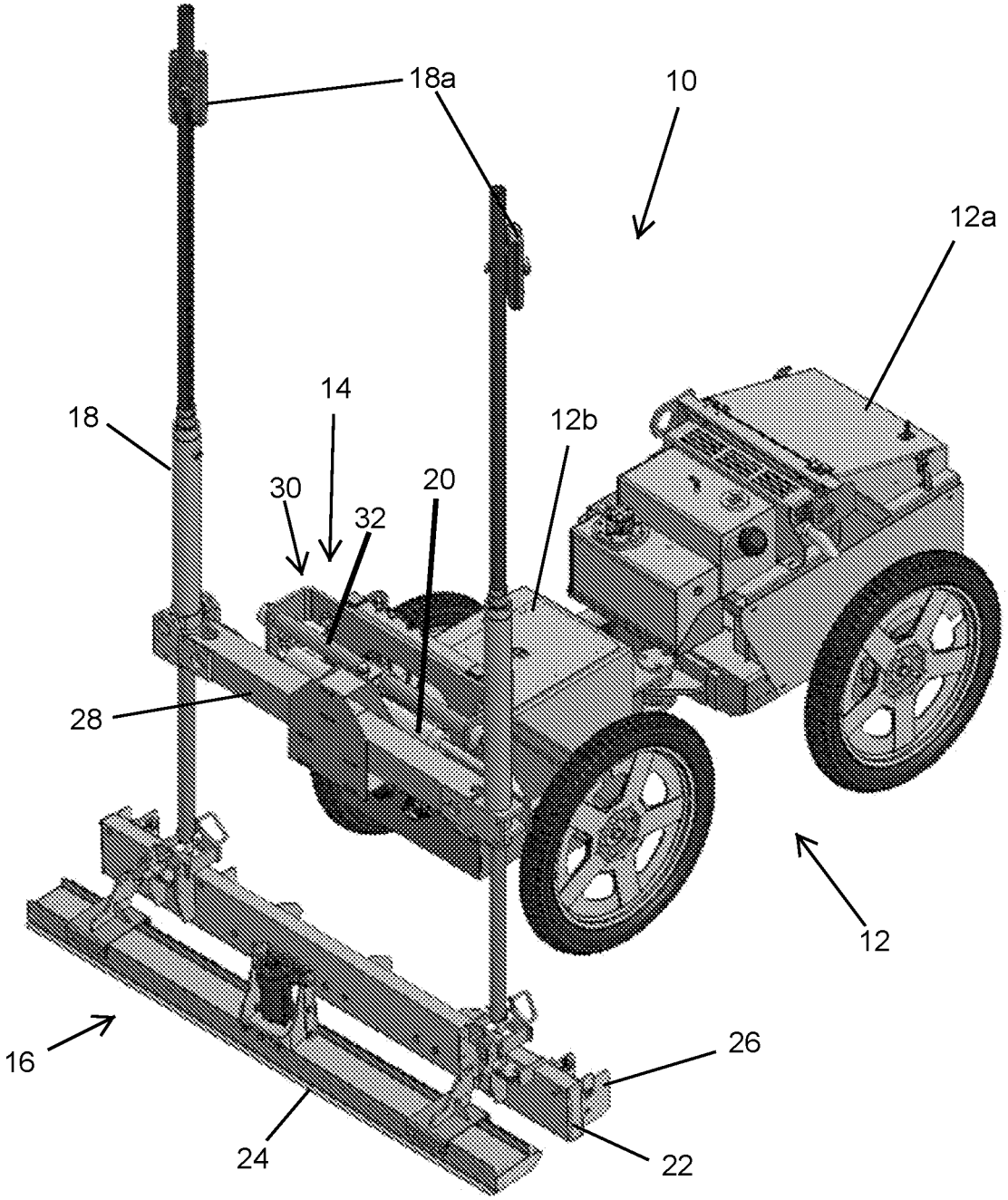
FIG. 1 is a perspective view of a concrete screeding machine.
Figure 2:
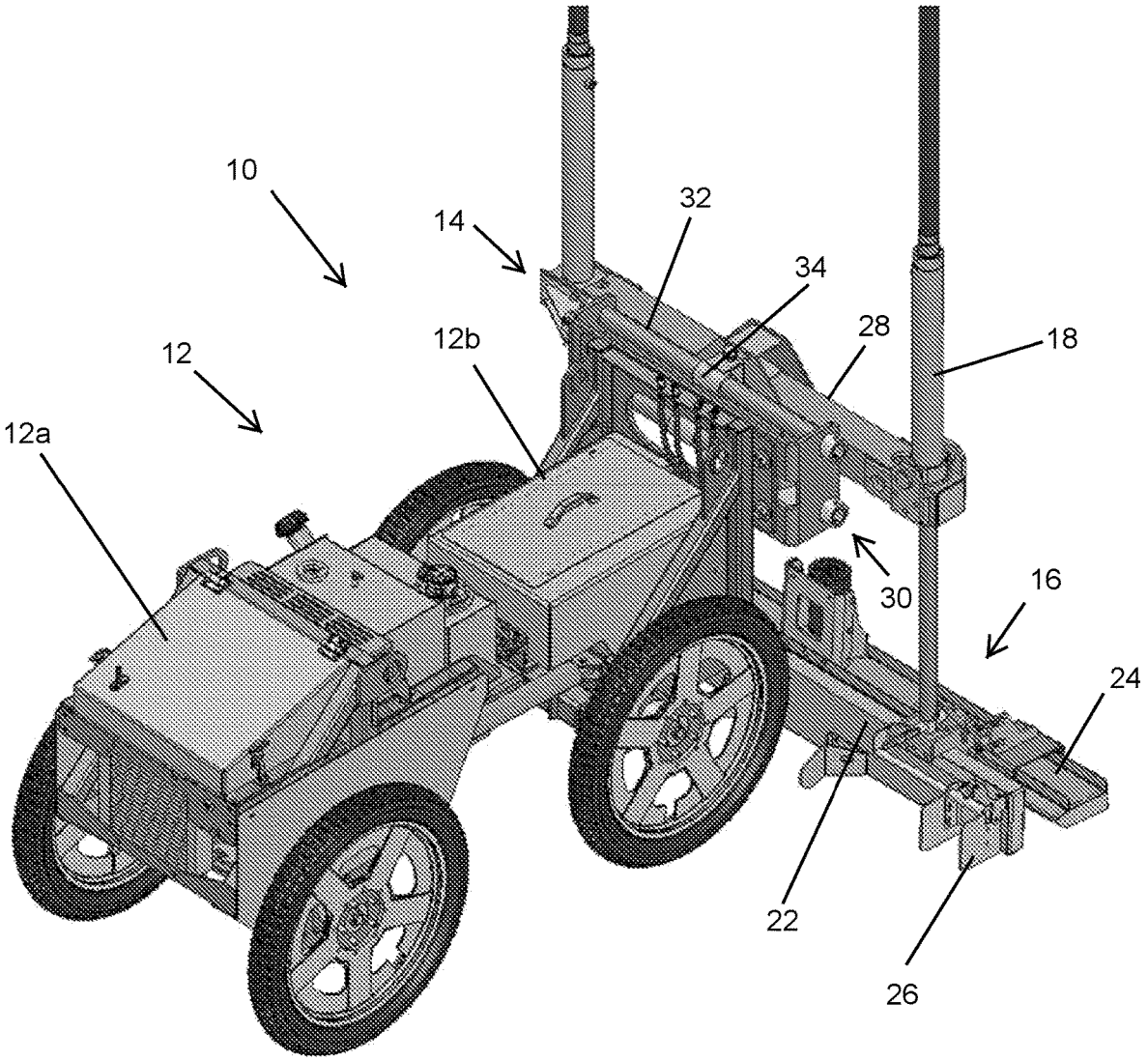
FIG. 2 is a perspective view of a concrete screeding machine of FIG. 1.
Figure 1A:
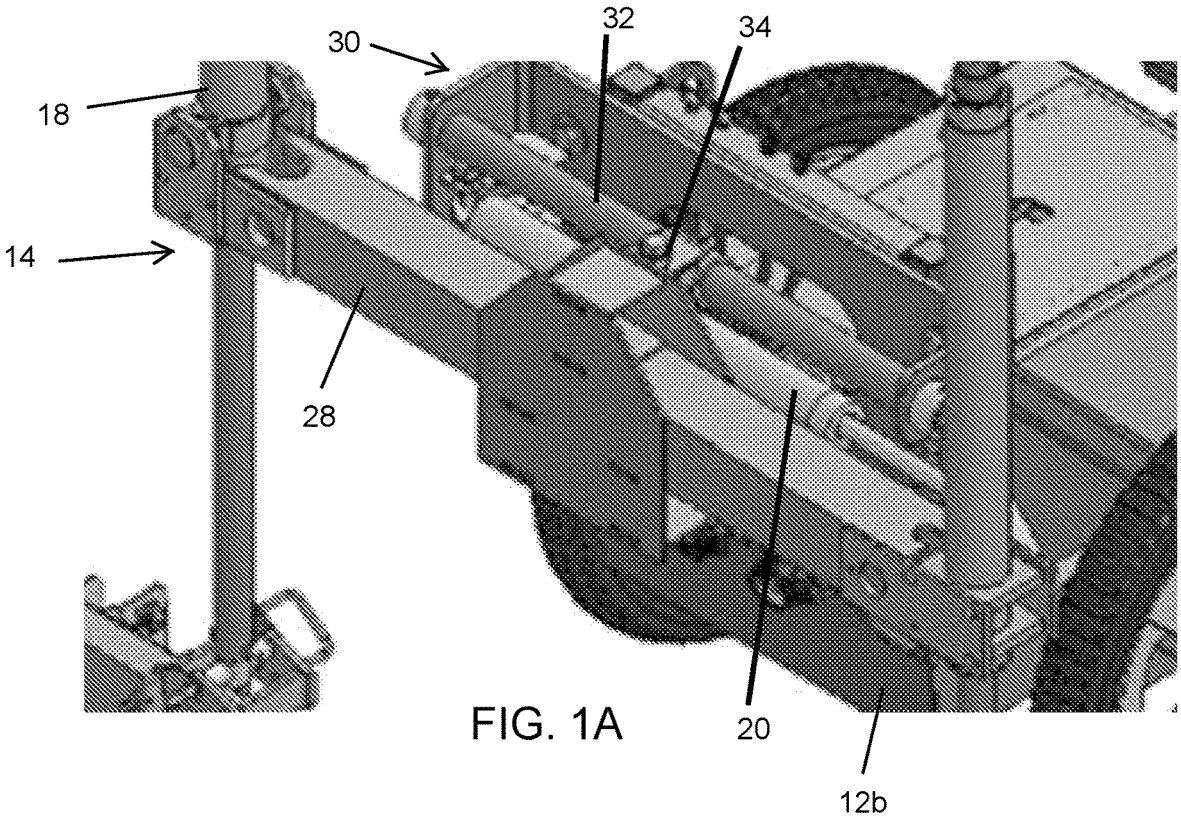
FIG. 1A is an enlarged perspective view of the support mechanism of the concrete screeding machine of FIG. 1.
Figure 2A:
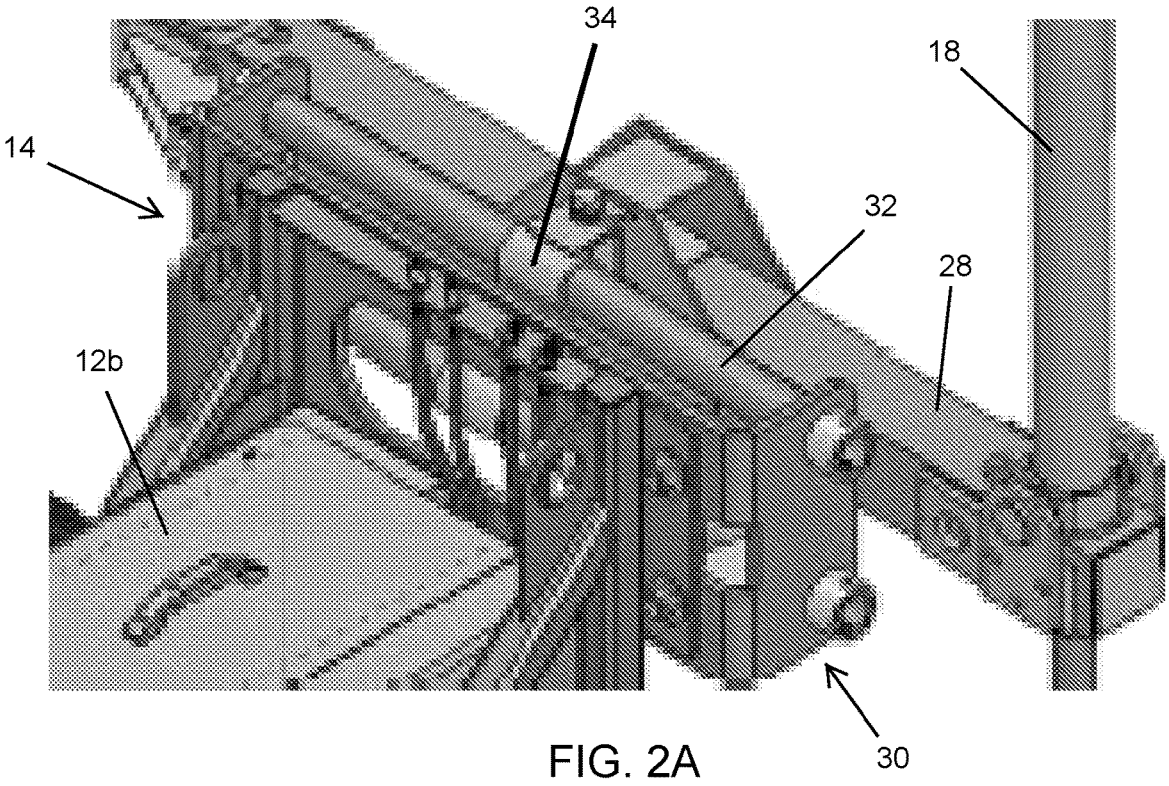
FIG. 2A is an enlarged perspective view of the support mechanism of the concrete screeding machine of FIG. 2.
Figure 3:
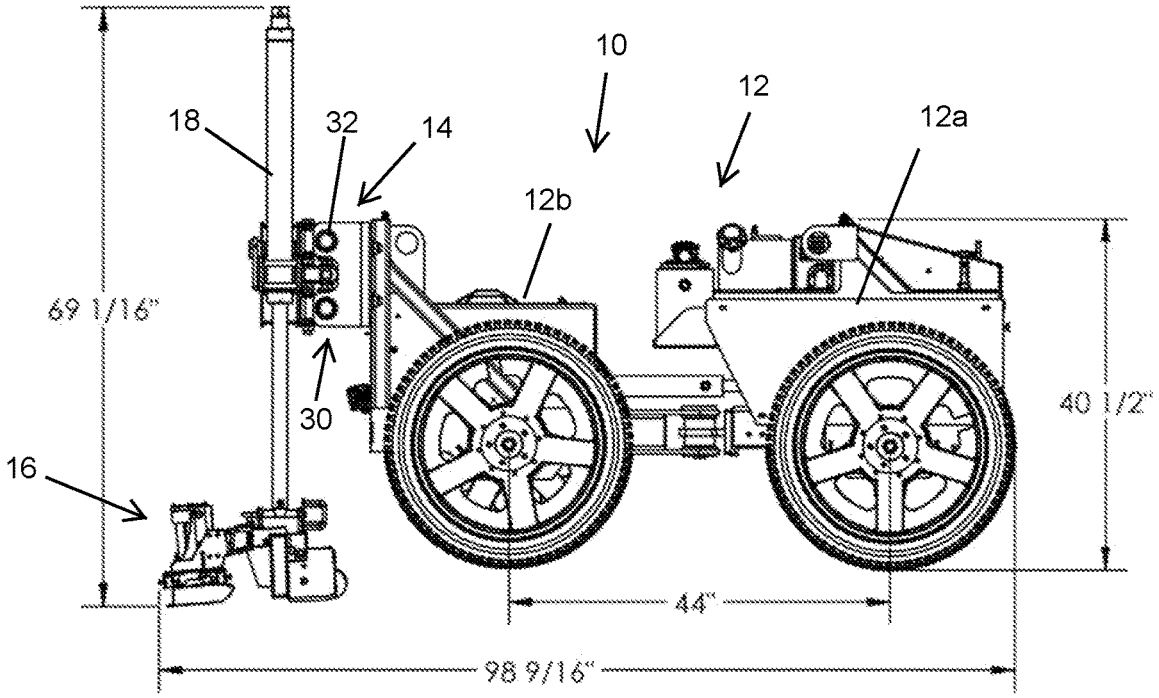
FIG. 3 is a side elevation of the concrete screeding machine of FIGS. 1 and 2, showing exemplary dimensions of features of the concrete screeding machine.
Figure 4:
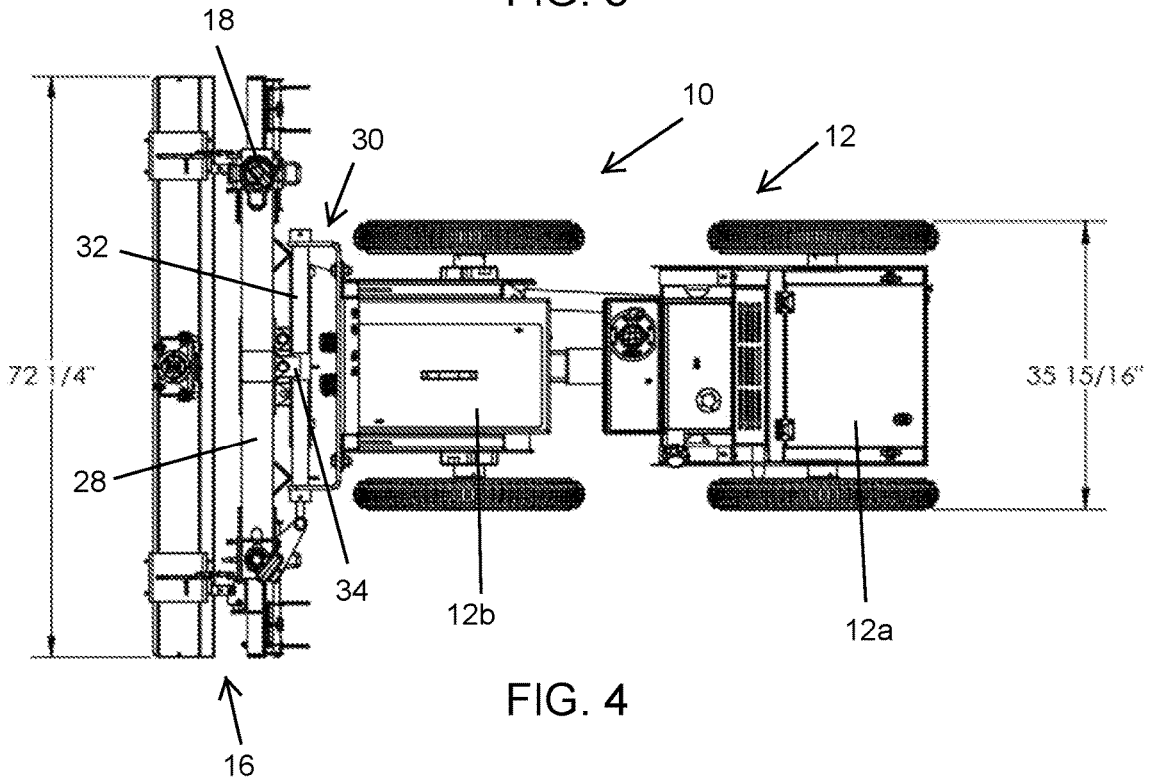
FIG. 4 is a top plan view of the concrete screeding machine of FIGS. 1 and 2, showing exemplary dimensions of features of the concrete screeding machine.
Figure 5:
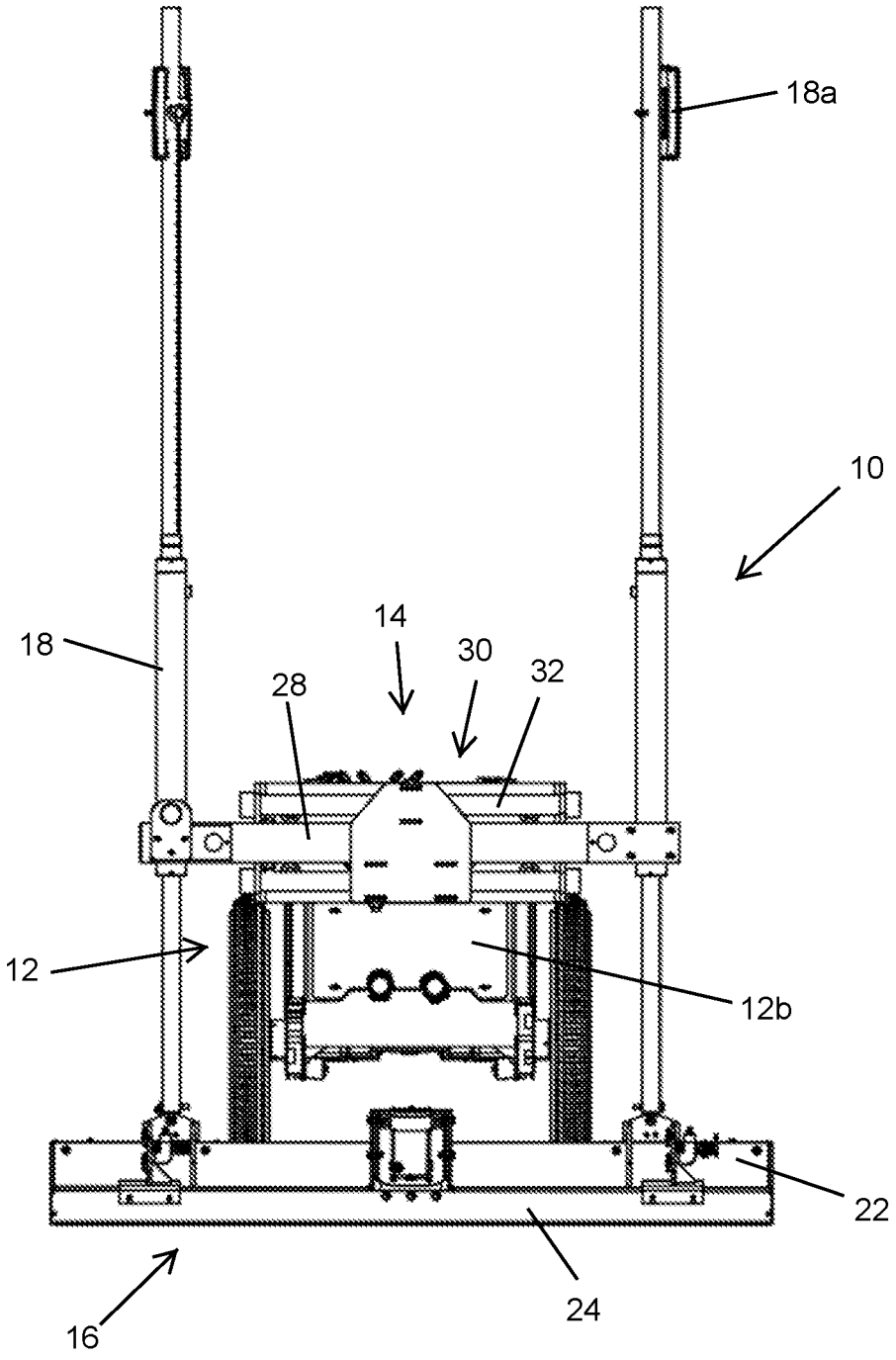
FIG. 5 is an end elevation of the concrete screeding machine of FIGS. 1 and 2.
Figure 6:
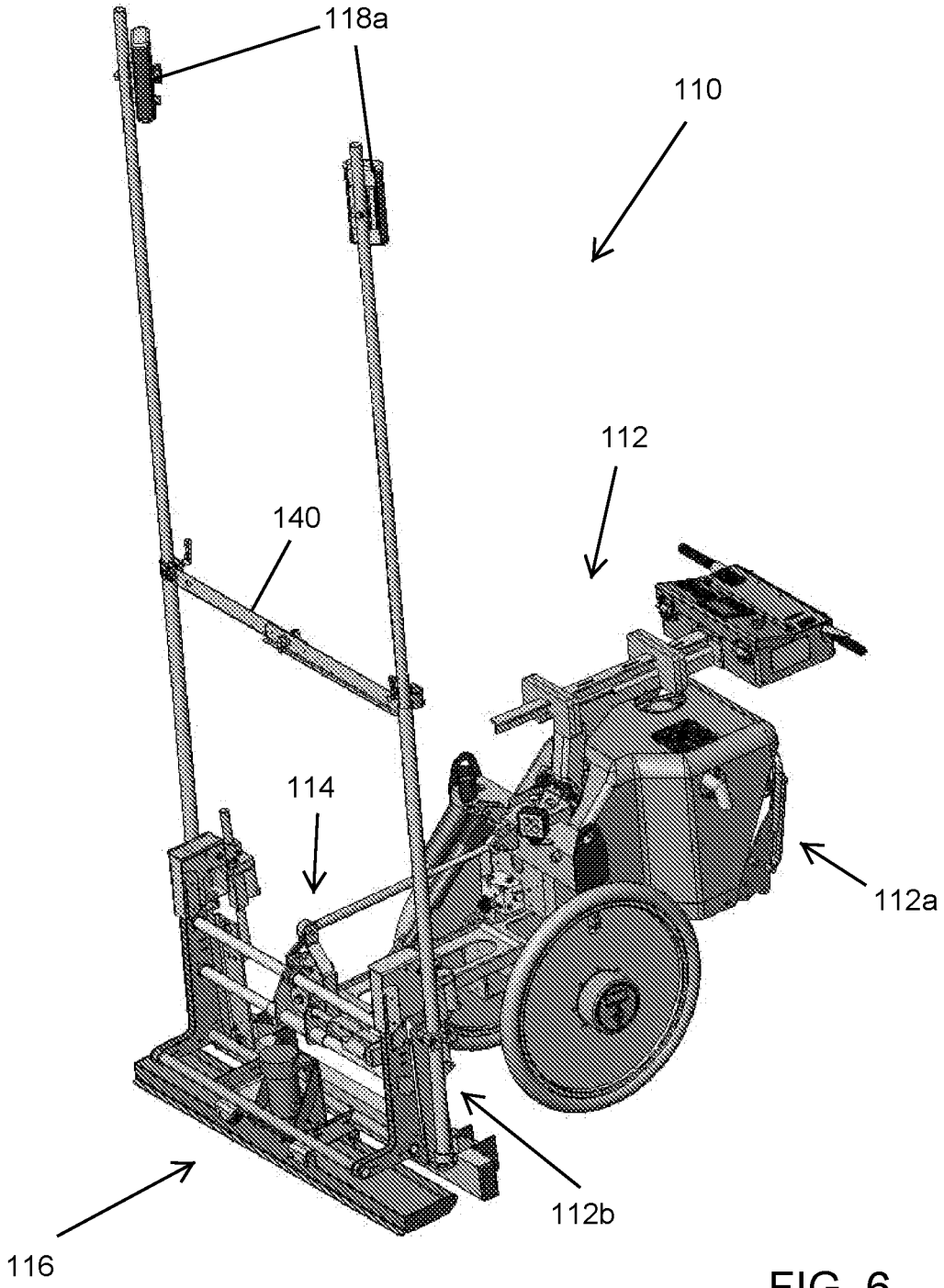
FIGS. 6-12 are views of another wheeled concrete screeding machine.
Figure 7:
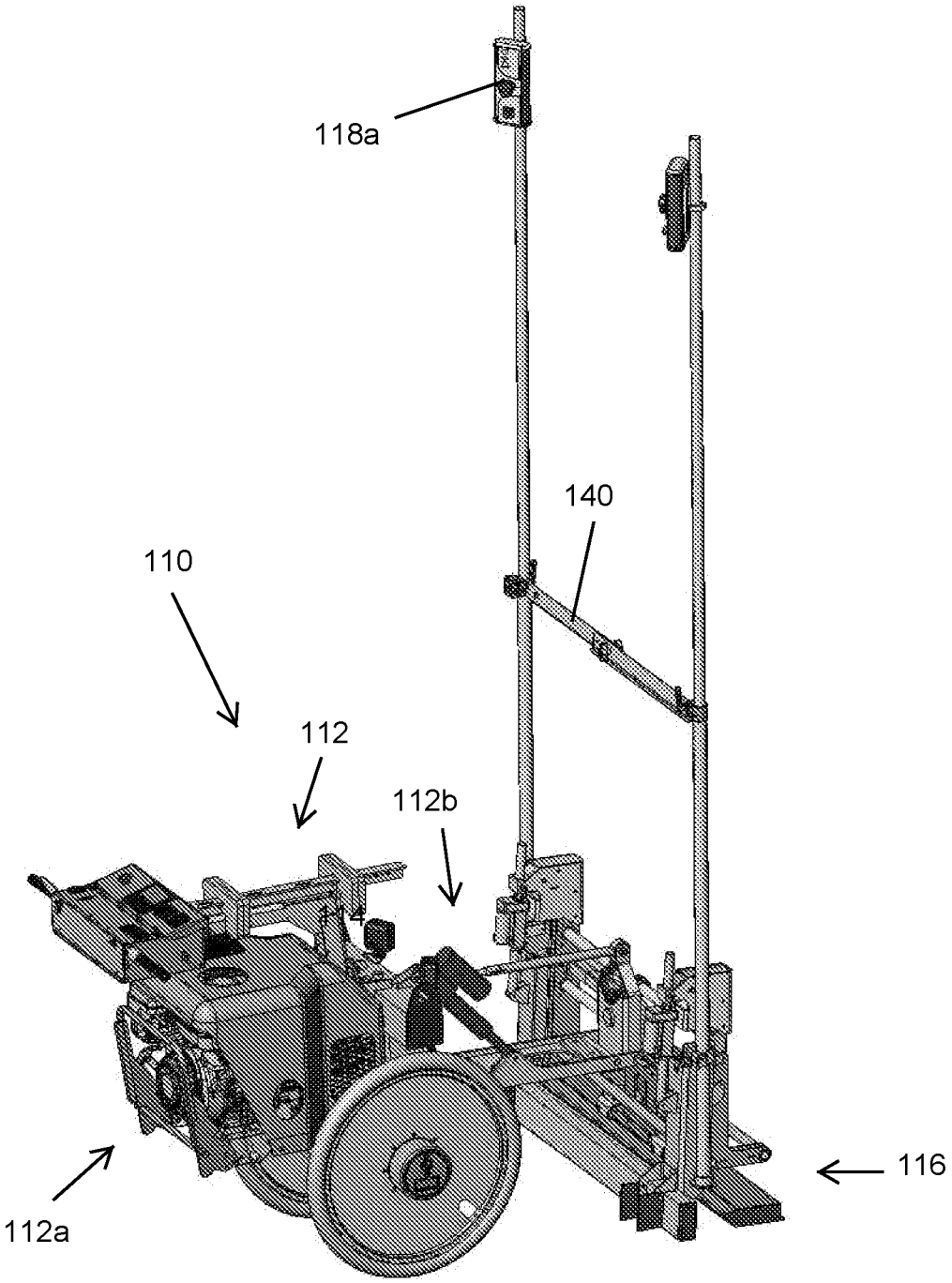
Figure 8:
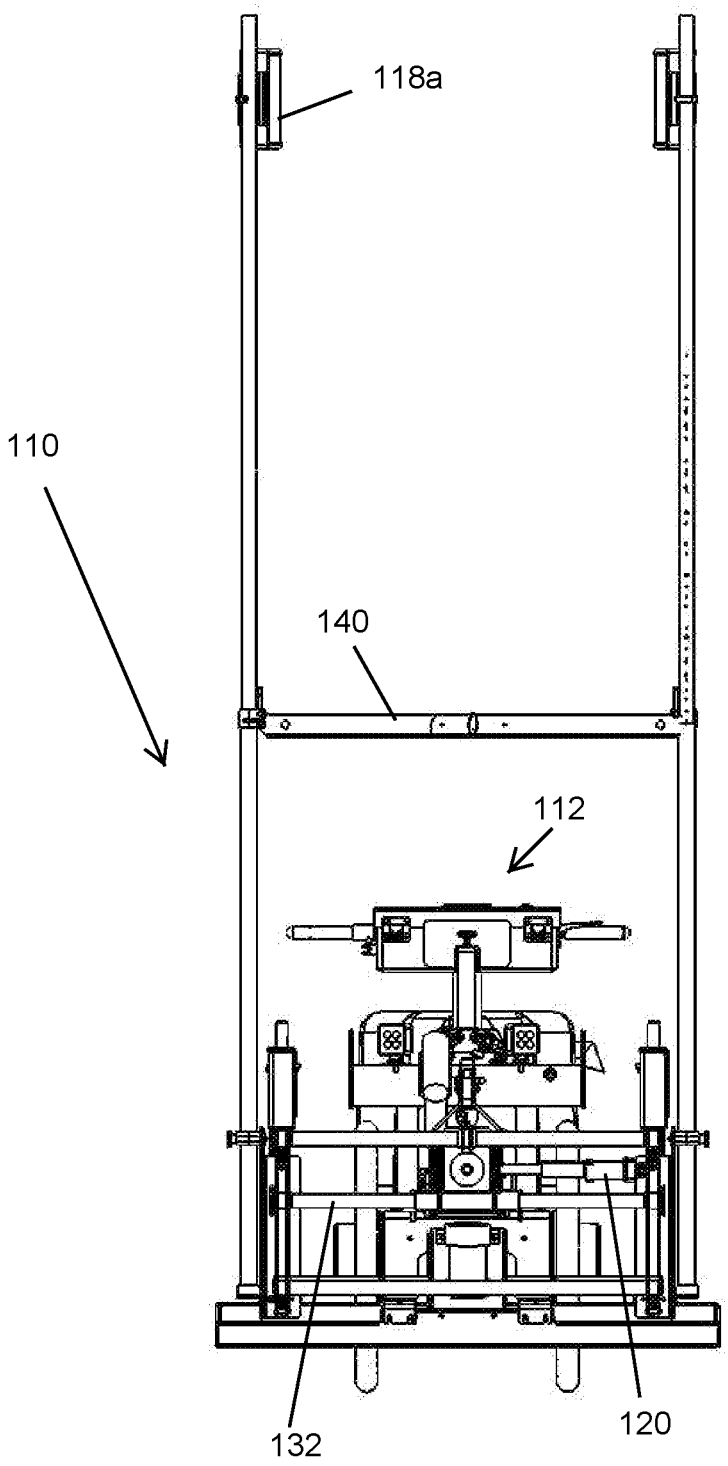
Figure 9:
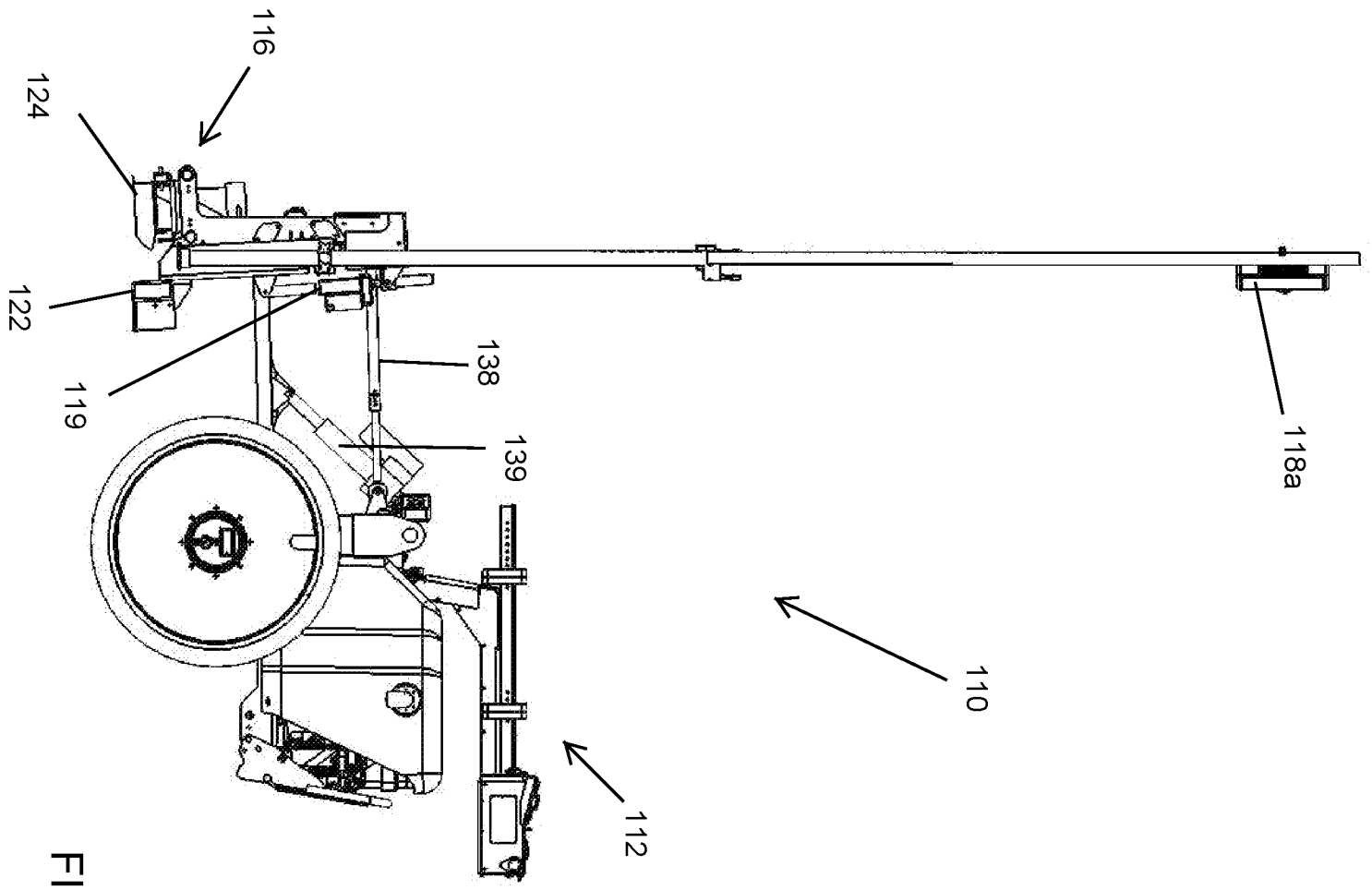
Figure 10:
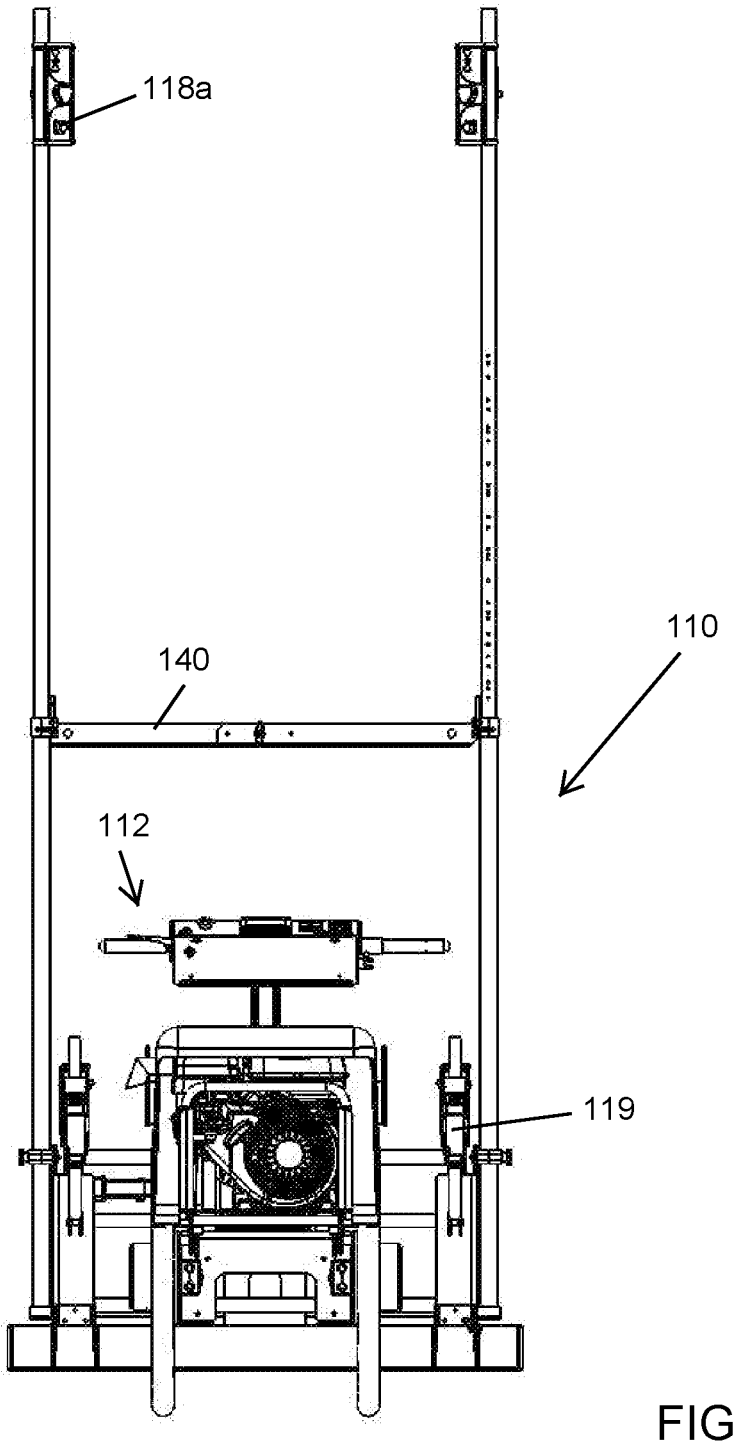
Figure 11:
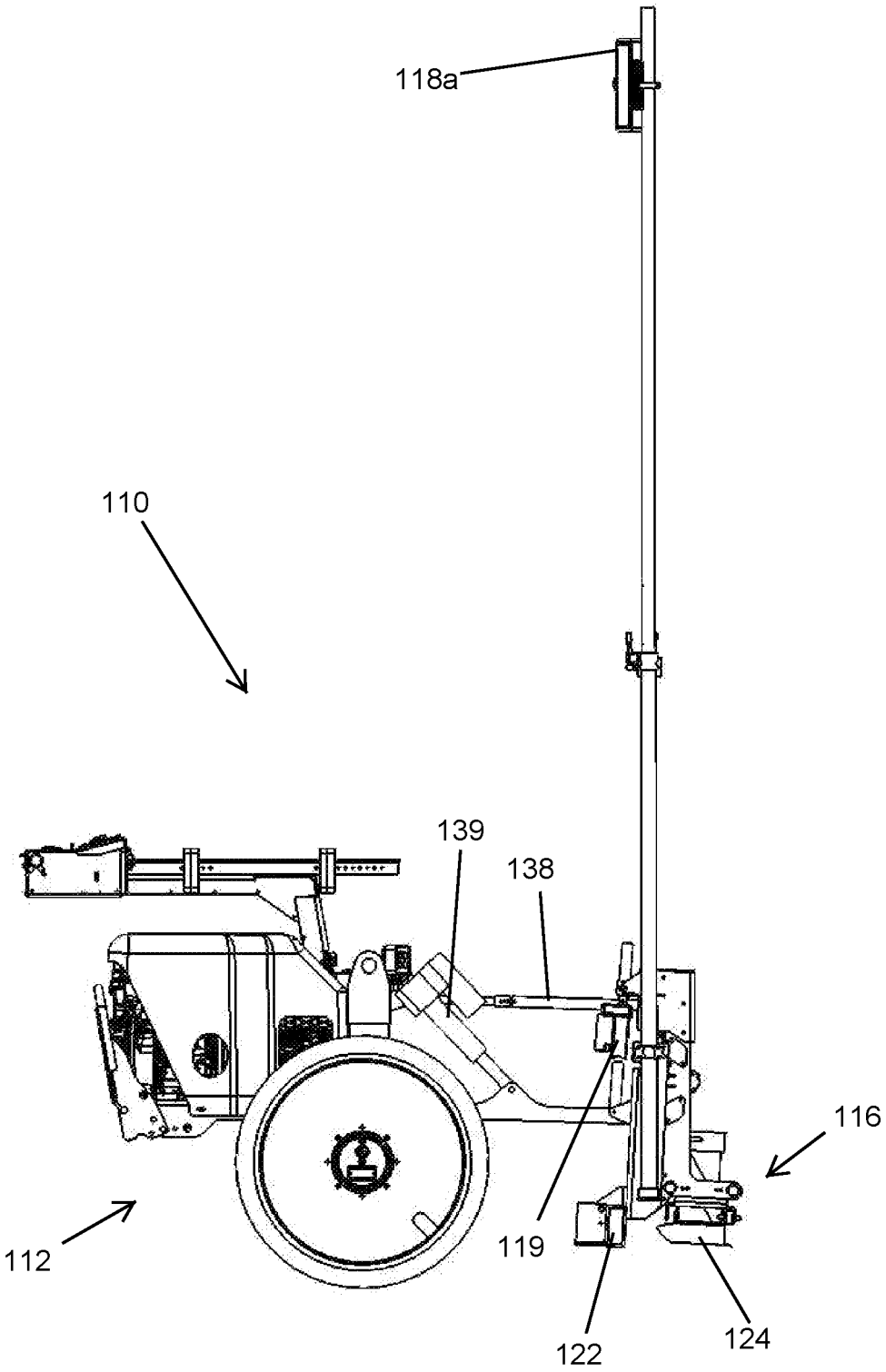
Figure 12:
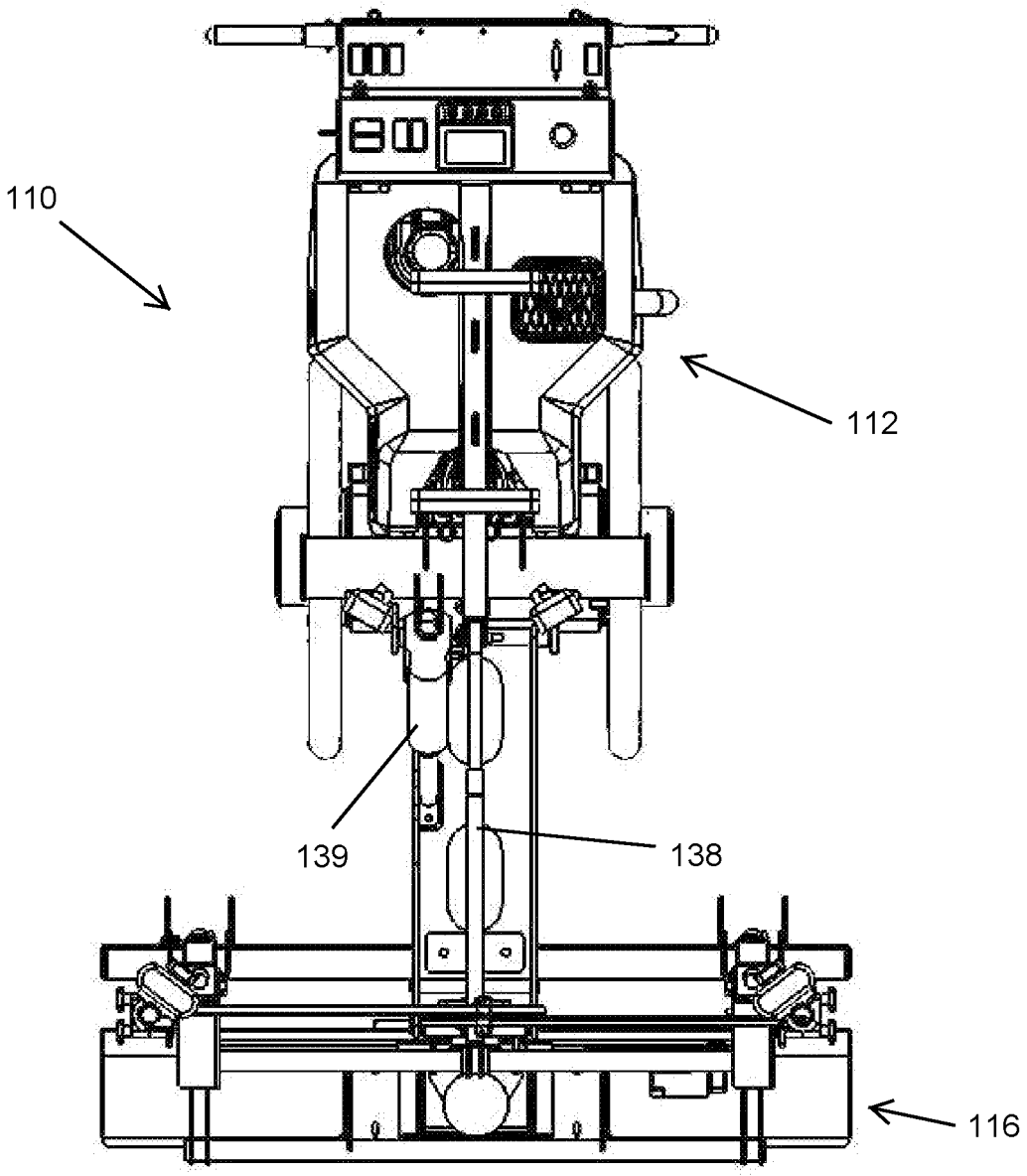
Figure 13:
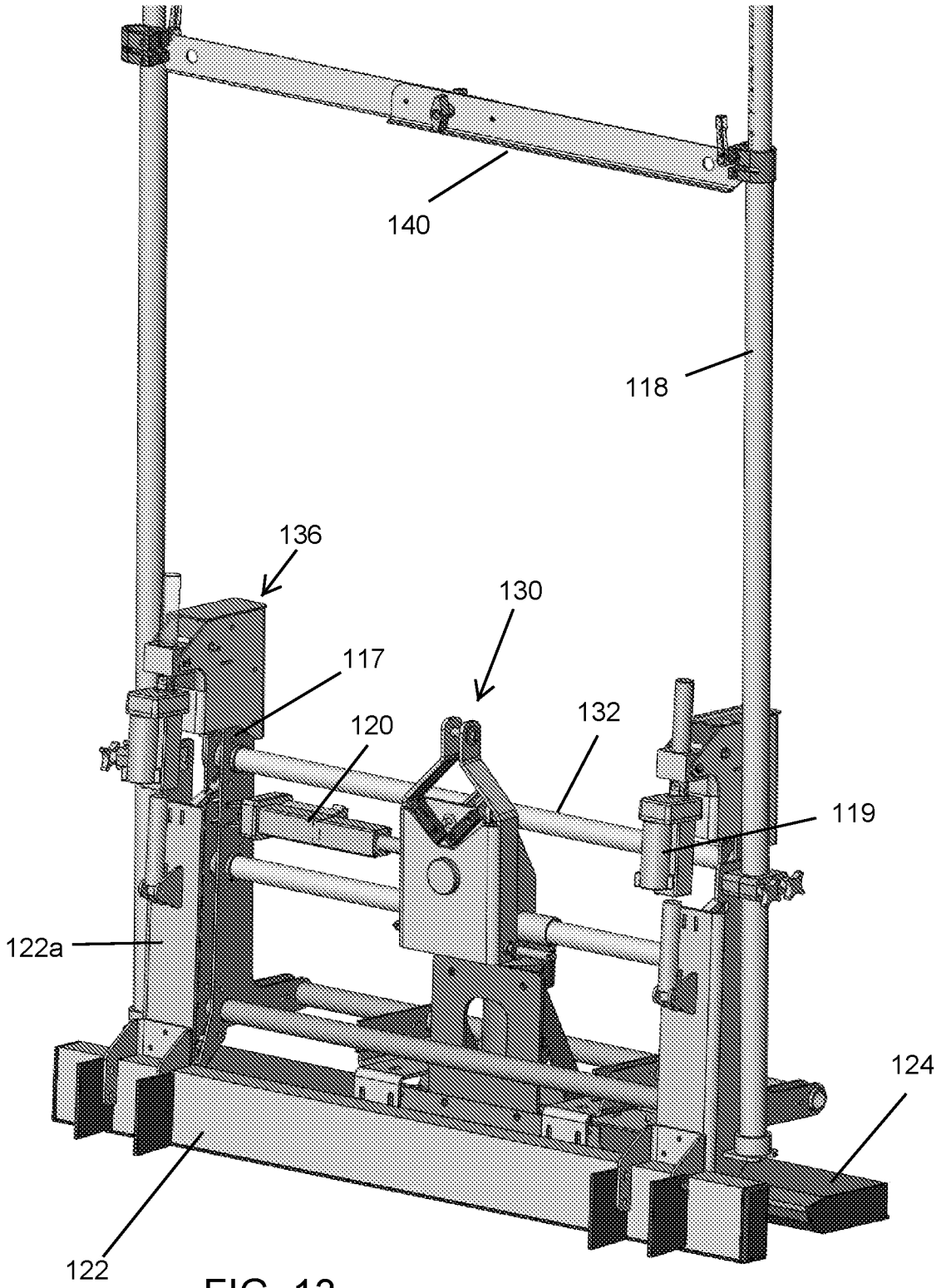
FIGS. 13 and 14 are perspective views of the screed head and support structure of the concrete screeding machine of FIGS. 6-12.
Figure 14:
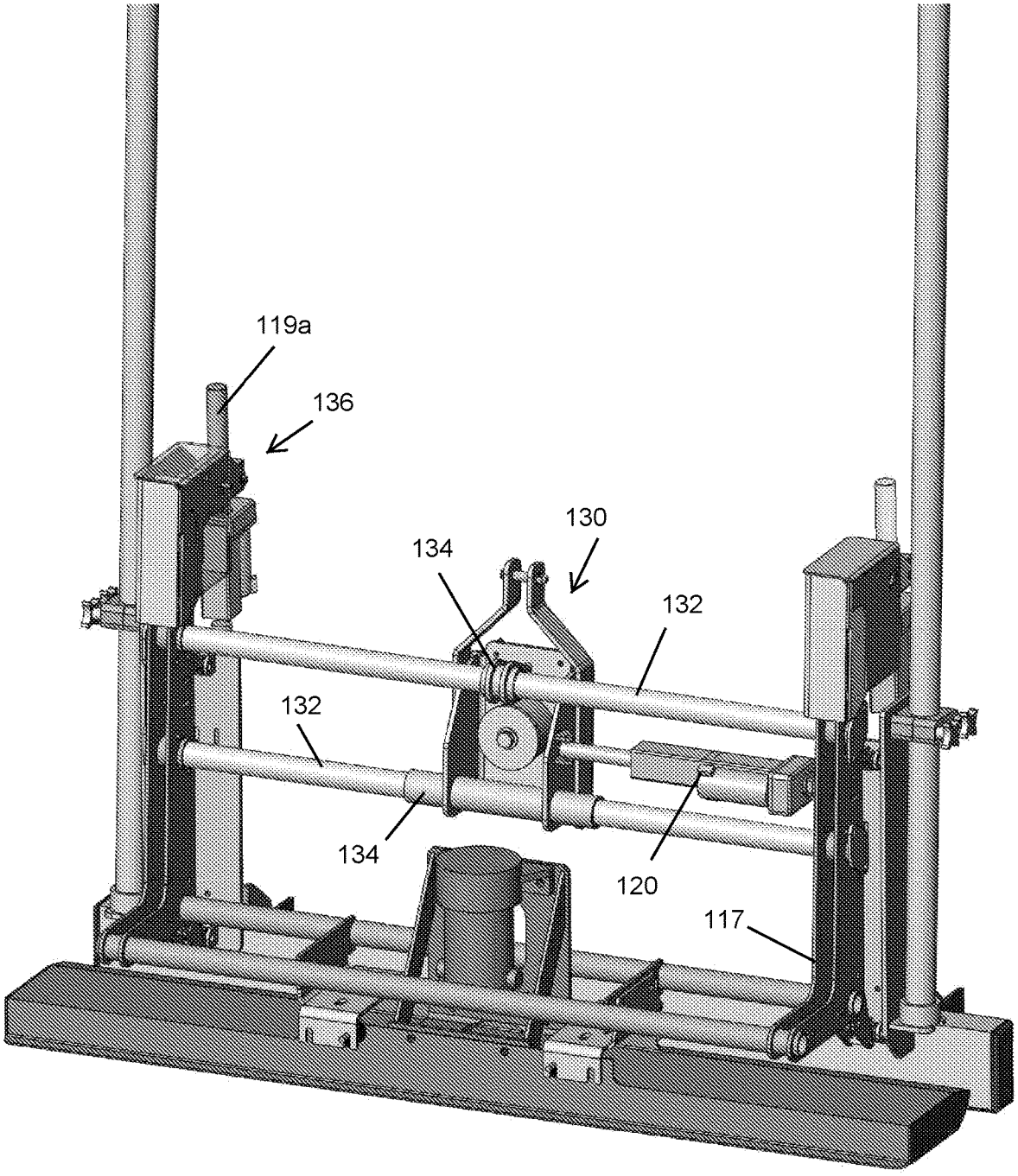
Figure 15:
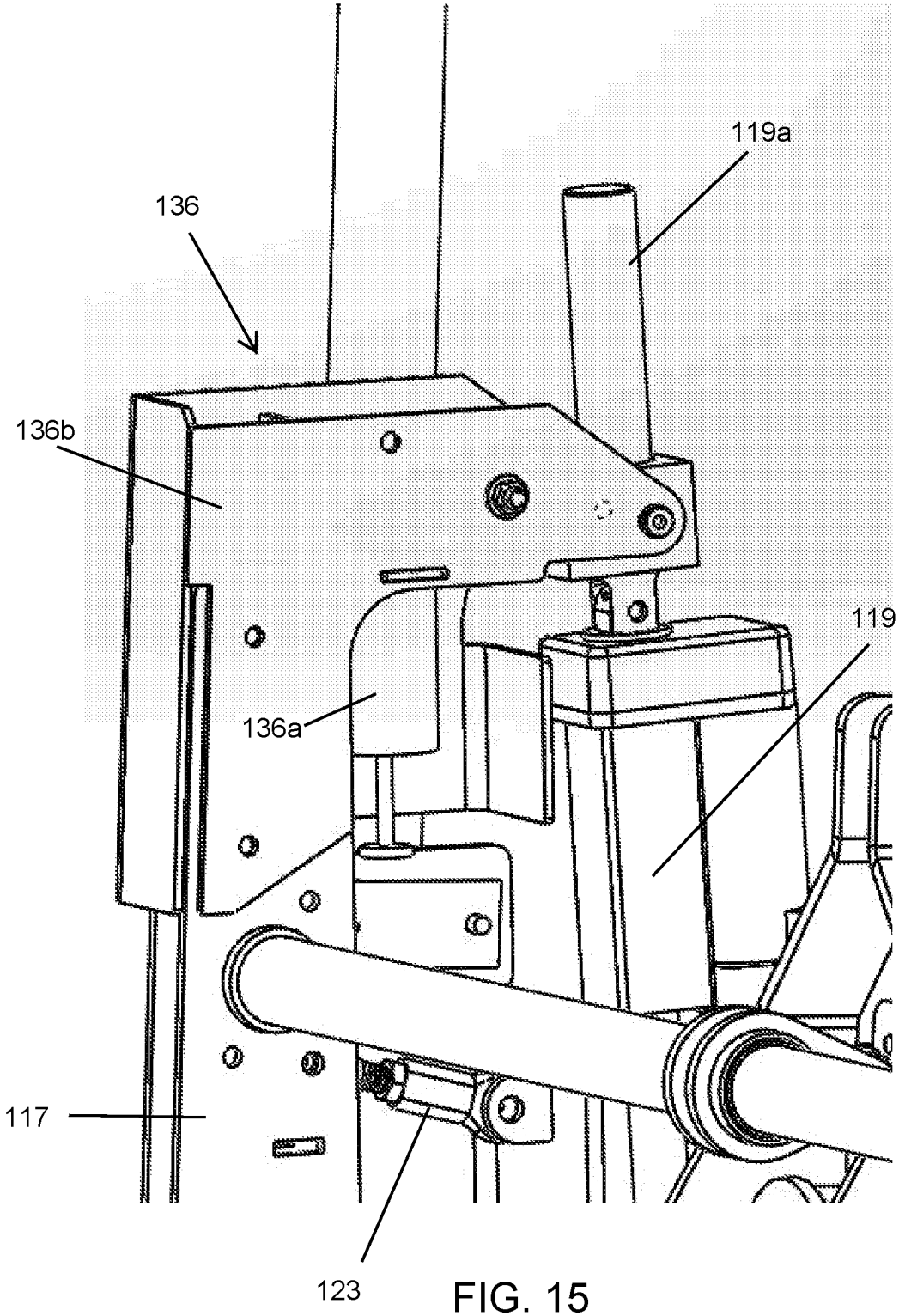
FIG. 15 is a perspective view of a mode setting device that operates to set the machine in a laser control mode or a float mode.
Figure 16:
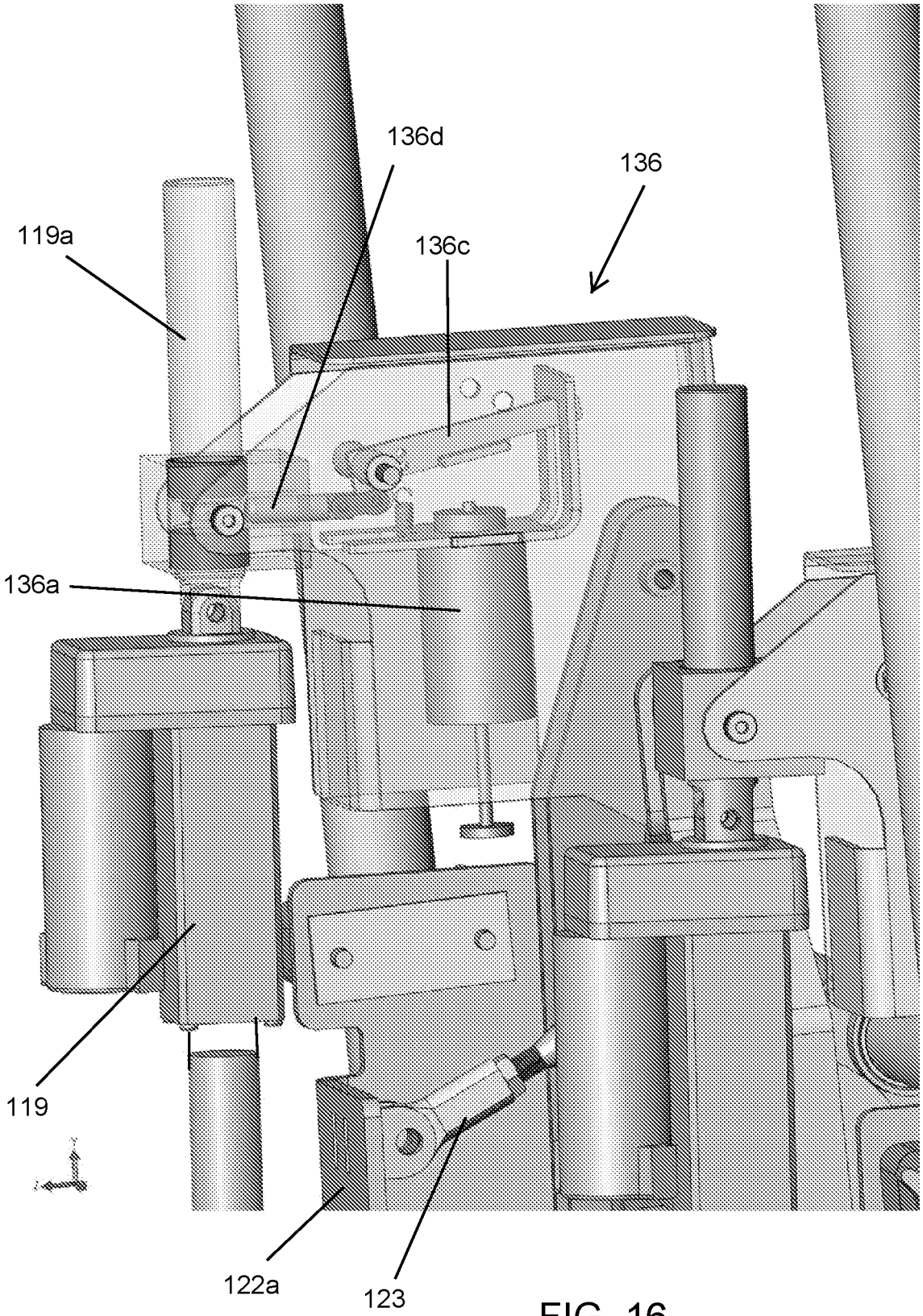
FIGS. 16-19 are views of the mode setting device when the screeding machine is set to the laser control mode.
Figure 17:
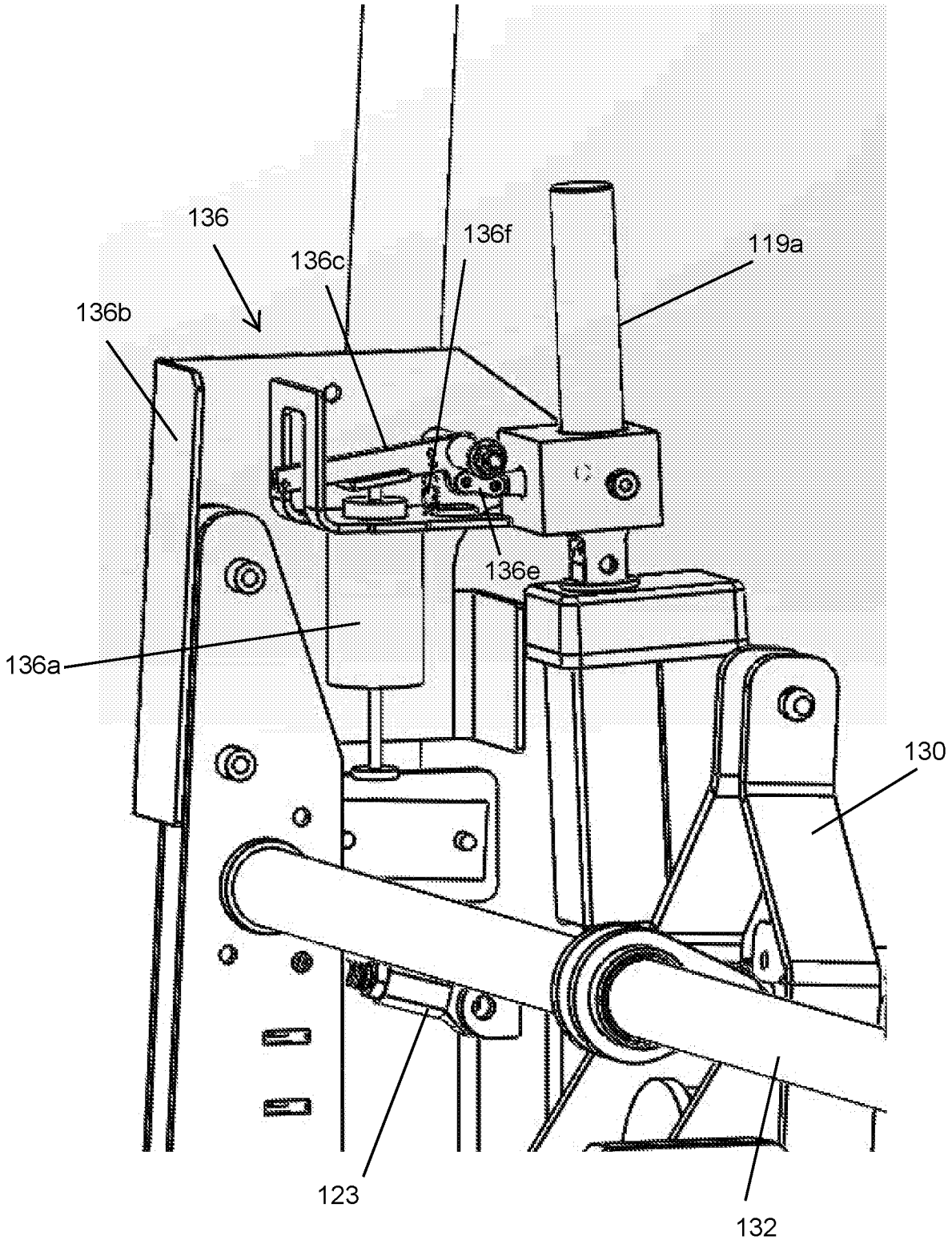

Referring now to the drawings and the illustrative embodiments depicted therein, a concrete screeding machine 10 includes a base unit 12 with a support mechanism 14 at an end of the base unit for supporting a screeding head or assembly 16 at an outer end thereof (FIGS. 1-5). The base unit 12 is movable or drivable to a targeted area at a support surface with uncured concrete placed thereat and then moved or driven along a screeding path while the screeding head 16 screeds the uncured concrete. The screed head is supported at the support mechanism 14 via a pair of elevation cylinders or actuators 18 that raise and lower the screeding head responsive to sensors 18*a* (such as laser receivers) disposed thereat. The support mechanism 14 includes a lateral actuator 20 that is operable to shift or adjust the screeding head 16 in a lateral direction (across the machine and in a direction generally orthogonal to a longitudinal axis of the screeding machine and generally orthogonal to the screed path). Thus, the screeding machine 10, when screeding uncured concrete along a wall or structure, is operable to urge the screeding head 16 toward and against the wall or structure so as to screed the concrete immediately adjacent the wall or structure as the screeding machine moves alongside the wall or structure, even if the path of travel of the screeding machine moves away from the wall or structure, as discussed below. The screeding machine may be operated in an edge "hugging" mode (where the lateral actuator urges the screed head towards the wall or structure), which may be selected by an operator (either via remote control or at the screeding machine) when the screeding machine is positioned at or alongside the wall or structure. The screeding machine may operate to screed the edges of a concrete slab or surface over the form boards (that are disposed along a wall or structure of the support surface) or over an existing slab, or the screeding machine may operate to screed the edges of newly placed uncured concrete that is forming a slab that is adjacent to a wall or structure at a support surface.

In the illustrated embodiment, the base unit 12 comprises an articulating wheeled base unit having a forward portion 12*a* (that leads the machine when operating in the screeding direction) and a rearward portion 12*b* (that trails the forward portion during the screed pass and that supports the screeding head). Each portion of the base unit includes at least one wheel. For example, each portion may have a pair of wheels, so that the base unit comprises four wheels, with at least some of the wheels being rotatably drivable and steerable to maneuver the base unit 12 and the screeding head 16 to an appropriate screeding position relative to the concrete to be screeded and to maneuver the base unit and the screeding head along the screed path.

The screeding head 16 includes a grade setting device 22 (such as a strike off plow, but could optionally include a vibrating plow and/or auger) and a vibrating member 24. The controller of the screeding machine individually controls the elevation actuators 18 of the screed head to raise and lower the screed head responsive to signals generated by sensors of the machine, such as, for example, responsive to signals generated by laser receivers 18*a*, which sense a laser reference plane generated at the work site, or such as, for example, 3D target/sonic tracers or any suitable sensor or sensing system that operates to generate an output indicative of the grade or angle or location of the screed head at the concrete. Optionally, the screeding head 16 may include adjustable plow wings 26 that are adjustably positioned at the grade establishing member or plow 22 and that are adjustable along the grade establishing member. The plow wings 26 function to limit excess concrete that is pushed by the grade establishing member from flowing around the ends of the plow, and may utilize aspects of the wings and machines described in U.S. Publication No. US-2022-0064971, which is hereby incorporated herein by reference in its entirety.

The screeding head 16 is supported at a cross beam 28 of the support mechanism 14 via the elevation actuators 18. The cross beam is adjustably or laterally-movably attached at a support structure 30 of the support mechanism 14 that is fixedly attached at the end of the base portion 12*b* of the base unit 12. In the illustrated embodiment, the support structure 30 comprises a pair of cylindrical supports 32 that extend laterally across the support structure, and the cross beam 28 includes a coupler 34 that slidably engages one or both of the cylindrical supports 32 so that the cross beam 28 (and elevation actuators and screeding head) are supported at and movable laterally along the cylindrical supports of the support structure. Although shown as cylindrical supports and a cylindrical coupler, clearly the supports and couplers may otherwise comprise a non-cylindrical cross sectional shape.

In the illustrated embodiment, the lateral actuator 20 of the support mechanism 14 is oriented generally parallel to or along the cylindrical supports, with one end of the actuator attached at the support structure 30 of the base unit 12 and the other end of the actuator attached at the cross beam 28. Thus, extension and retraction of the lateral actuator 20 causes lateral movement of the cross beam (and the elevation actuators and the screeding head) relative to the support structure 30 (and the base unit).

The lateral actuator may comprise a double ended hydraulic cylinder that is extendable via pressurized fluid at one end and is retractable via pressurized fluid at the other end. The lateral actuator may comprise a pressure relief valve (or other means to control pressure or force) that allows pressure to escape so that the cross beam 28 can be moved in a direction opposite the direction it is being urged by the lateral actuator. Thus, if the path of travel of the base unit moves toward the wall or structure, the screeding head position relative to the base unit adjusts (such as when the pressure in the actuator exceeds a threshold pressure) to avoid forcing the screeding head further into the wall or structure. Extension of the lateral actuator (beyond a centered or initial position or state) may move the screeding head toward one side of the base unit for screeding along a wall or structure at that side, and retraction of the lateral actuator (beyond the centered or initial position or state) may move the screeding head toward the other side of the base unit for screeding along a wall or structure at that side.

Although shown and described as the lateral actuator comprising a horizontally oriented extendable and retractable hydraulic cylinder or actuator, the lateral actuator may comprise any suitable laterally shifting device or actuator or means that, when powered or operated or engaged, imparts lateral movement of the screed head in one direction or the other. For example, the lateral actuator may comprise a non-horizontal linear actuator that engages and moves one or more pivotable linkages to impart horizontal translational movement of the screed head, or the lateral actuator may comprise a motor that is rotatably driven to drive or move a belt or chain to rotate a sprocket or gear to cause translational movement of the screed head (such as via a rack and pinion type arrangement), or the lateral actuator may comprise a spring-loaded element or device or biasing element that biases or urges the screed head toward one side or the other when actuated or engaged. Optionally, it is envisioned that lateral shifting of the screed head relative to the base portion may be achieved via a manually operated device or mechanism, which may urge (such as via spring force or the like) the screed head in either lateral direction when actuated or engaged.

When the screeding machine is positioned at a start or starting location of a screeding pass or path (such as at a side of the wall or structure), an operator of the screeding machine may select (via a remote controller or via a control panel at the base unit) the wall/structure or edge "hugging" mode and the lateral actuator 20 of the support mechanism 14 is actuated (extended or retracted depending on which side of the machine the wall or structure is located) to urge the screeding head 16 toward and against the wall or structure. The screeding machine is then moved along the concrete and alongside the wall or structure while the screeding head 16 operates to establish a desired grade of the concrete surface and smooth or finish or screed the concrete. The lateral actuator maintains sufficient pressure against the support beam to maintain the screeding head against the wall or structure while the screeding head is moved upward or downward via the elevation actuators as the screeding machine moves along the concrete surface alongside the wall or structure. If the base unit moves a little away from the wall or structure while the machine is operating in the wall/structure "hugging" mode, the lateral actuator adjusts or extends or retracts further to maintain the screeding head against the wall or structure. If the base unit moves a little toward the wall or structure while the machine is operating in the wall/structure "hugging" mode, the increased pressure caused by the base unit urging the screeding head toward the wall causes (via the pressure relief valve or other pressure controlling means) the lateral actuator to retract or extend (in the opposite direction or in the direction away from the wall or structure) to maintain the screeding head against the wall or structure at approximately the same pressure or force against the wall or structure.

Although described above as having a pressure relief valve that allows the screed head to move in the opposite direction that it moved when the lateral actuator was actuated, the screeding machine may include other means for allowing such movement when a greater force is applied at the screed head. For example, the actuator or support may include a spring that urges the screed head toward the wall or structure and that may compress (or elongate) to allow the screed head to move in the opposite direction if the screeding machine is moved closer to the wall or structure. Optionally, for example, the actuator or support may include an accumulator that may hold a volume of hydraulic fluid at a pre-determined pressure and that allows the head to extend or retract while pushing or pulling hydraulic fluid into or out from the accumulator body.

Optionally, the screeding machine may include a lateral sensor that senses the position of the screed head relative to the wall or structure, and the lateral actuator may operate responsive to sensing by the lateral sensor. For example, the lateral sensor may comprise a camera or imaging sensor that captures image data representative of the end of the screed head and the wall or structure, whereby the lateral actuator (responsive to processing at the controller of the captured image data) operates (e.g., extends or retracts) to maintain the screed head at the wall or structure (or at a desired gap from the wall or structure). Optionally, the lateral sensor may comprise a contact sensor that extends from the end of the screed head and contacts the wall or structure so that the controller and machine determine when the screed head is at the wall or structure.

In the illustrated embodiment, the lateral actuator and laterally movable support mechanism are disposed at the end of the wheeled base unit above the screed head, with the screed head being vertically adjustable relative to the support via the elevation actuators. Optionally, the lateral actuator and laterally movable support mechanism may be disposed at the screed head assembly, such as at the lower end of the elevation actuators, whereby actuation of the lateral actuator moves the plow and vibrating member of the screed head toward the wall or structure, such as in a similar manner as described above. The elevation actuators and screed head assembly (including the lateral actuator and laterally movable support mechanism) may be attached at a fixed support or cross beam at the end of the wheeled base unit.

The screeding machine comprises a pressurized hydraulic fluid system powered by an engine at the base unit that drives the hydraulic system to generate pressurized fluid for controlling the elevation actuators or cylinders 18 and for controlling the extension and retraction of the lateral actuator and for controlling operation of the vibrating member and for driving and steering of the wheels of the base unit. The screeding machine 10 and the screeding head or assembly 16 may utilize aspects of the screeding machines and screeding heads described in U.S. Pat. Nos. 4,655,633; 4,930,935; 6,227,761; 6,976,805; 7,044,681; 7,121,762; 7,175,363; 7,195,423; 7,396,186; 7,850,396; 8,038,366; 9,835,610; 10,190,268 and/or 10,895,045, and/or U.S. Publication Nos. US-2022-0316154; US-2010-0196096 and/or US-2007-0116520, which are all hereby incorporated herein by reference in their entireties.

The screeding machine 10 is suitable for use in screeding concrete alongside walls or structures, including around columns at a support surface. The screeding head may float on the concrete surface or may be supported at wooden forms or frames at the support surface that form or shape or define the concrete being formed, with such frames or forms comprising 2×10 or 2×12 (or other suitable size) wooden form boards or beams that are cut and supported on edge at the support surface to form or define the shape of the concrete surface.

Because the screeding head 16 may be moved from locations where the forms or framework are present to locations where no forms or framework is present, the operation of the screeding machine may be adjusted to adapt for the changes in the type of screeding that is desired for the different locations. The screeding machine 10 thus may adjust the operating mode when the screed head is moved from screeding concrete at a location where there are no frames or forms present to a location where a frame or form is at one or both of the ends of the screed head, such as by utilizing aspects of the screeding machines described in U.S. Publication No. US-2022-0064971, which is hereby incorporated herein by reference in its entirety. For example, when the screed head 16 is screeding concrete where no forms are present, the system may operate in a sensor control mode, where the screed head is raised and lowered responsive to signals from the elevation sensors 18*a* (e.g., laser receivers) to maintain the screeding head 16 at the desired or appropriate or set grade. When the screeding head 16 is moved to a location where forms or frames are present, the machine can switch to a float mode where the sensor control is turned off and the screed is allowed to float or rest on the forms or frames as the screed head is moved along to screed the concrete.

The screeding machine may be controlled by an operator (that may sit or stand at the base unit or may walk next to the base unit) or may be remote controlled via a remote controller (whereby an operator may be located at a location remote from the placed uncured concrete that is being screeded by the screeding machine). The base unit may comprise a two or three or four (or more) wheeled device and may comprise an articulating frame (with two wheels at one portion and at least one wheel at the other portion). The screed head may comprise a six foot head or may comprise a smaller or larger head depending on the particular application of the screeding machine. The elevation cylinders include masts for the laser receivers, and the masts may comprise longer masts (e.g., 8 foot masts or 10 foot masts or longer) for use on large line jobsites. The screeding machine includes a side shifting screed head (with the wall/structure hugging mode of operation) and form float capabilities. Optionally, the machine may comprise a plow vibrator or may comprise an immersion vibrator. Optionally, the support beam may comprise a folding beam to allow the machine to fit (when the beam is folded) through smaller doors at the jobsite.

Optionally, a screeding machine 110 (see FIGS. 6-21) includes a base unit 112 with a support mechanism 114 at an end of the base unit for supporting a screeding head or assembly 116 at an outer end thereof, with the base unit 112 being movable or drivable to a targeted area at a support surface with uncured concrete placed thereat and then moved or driven along a screeding path while the screeding head 116 screeds the uncured concrete. The support mechanism 114 may include a lateral actuator 120 that is operable to shift or adjust the screeding head 116 in a lateral direction (across the machine and in a direction generally orthogonal to a longitudinal axis of the screeding machine and generally orthogonal to the screed path). Thus, the screeding machine 110, when screeding uncured concrete along a wall or structure, is operable to urge the screeding head 116 toward and against the wall or structure so as to screed the concrete immediately adjacent the wall or structure as the screeding machine moves alongside the wall or structure, even if the path of travel of the screeding machine moves away from the wall or structure, such as in a similar manner as discussed above with respect to screeding machine 10.

In the illustrated embodiment, the base unit 112 comprises a walk-behind wheeled base unit having a forward portion 112*a* (that leads the machine when operating in the screeding direction and that has a control panel for the operator to use) and a rearward portion 112*b* (that trails the forward portion during the screed pass and that supports the screeding head). The base unit includes two wheels, with the wheels being rotatably drivable and steerable to maneuver the base unit 112 and the screeding head 116 to an appropriate screeding position relative to the concrete to be screeded and to maneuver the base unit and the screeding head along the screed path. The rear portion includes the support mechanism 114, and an adjustable link 138 may connect between the wheeled base unit and the support mechanism and can be set at a desired or selected length to adjust an attack angle of the screed head, such as when the screed head is raised or lowered relative to the wheeled base unit via an actuator 139.

Similar to the screeding head 16, discussed above, the screeding head 116 includes a grade setting device 122 (such as a strike off plow, but could optionally include a vibrating plow and/or auger) and a vibrating member 124. The controller of the screeding machine 110 individually controls actuators 119 of the screed head to raise and lower the grade setting member relative to the vibrating member of the screed head responsive to signals generated by sensors of the machine, such as, for example, responsive to signals generated by laser receivers 118*a*, which sense a laser reference plane generated at the work site, or such as, for example, 3D target/sonic tracers or any suitable sensor or sensing system that operates to generate an output indicative of the grade or angle or location of the screed head at the concrete.

Figure 18:
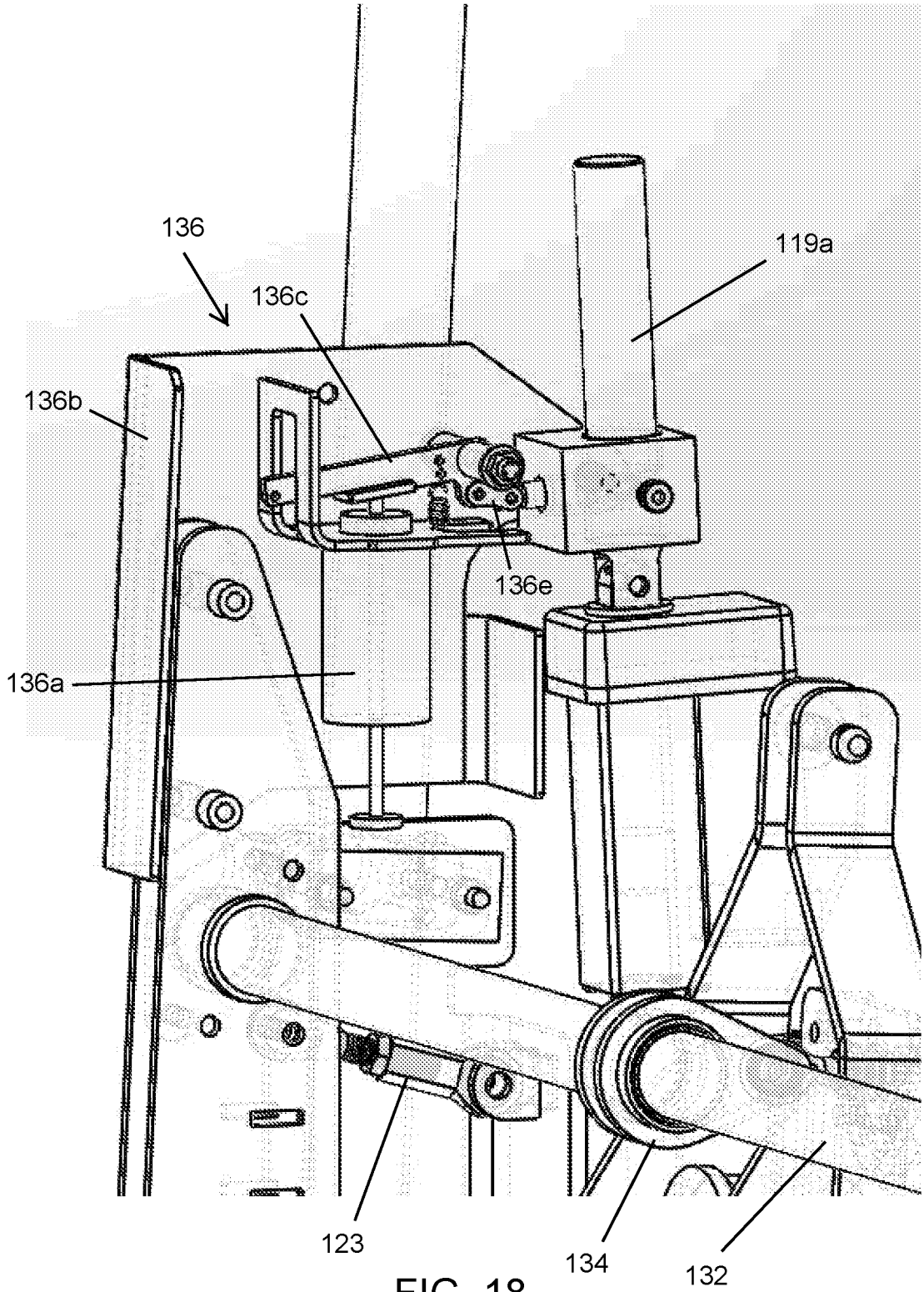
Figure 19:
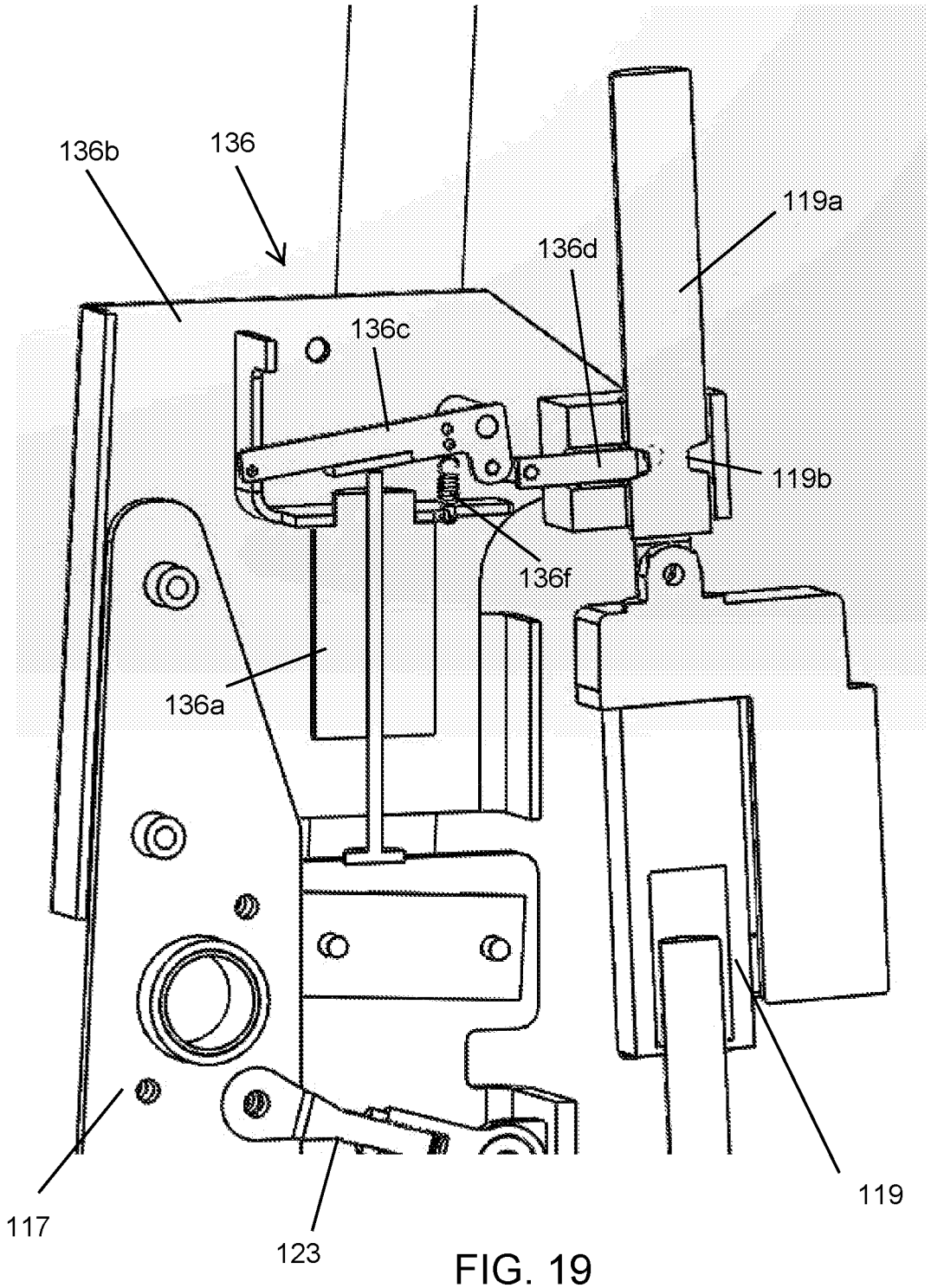
Figure 20:
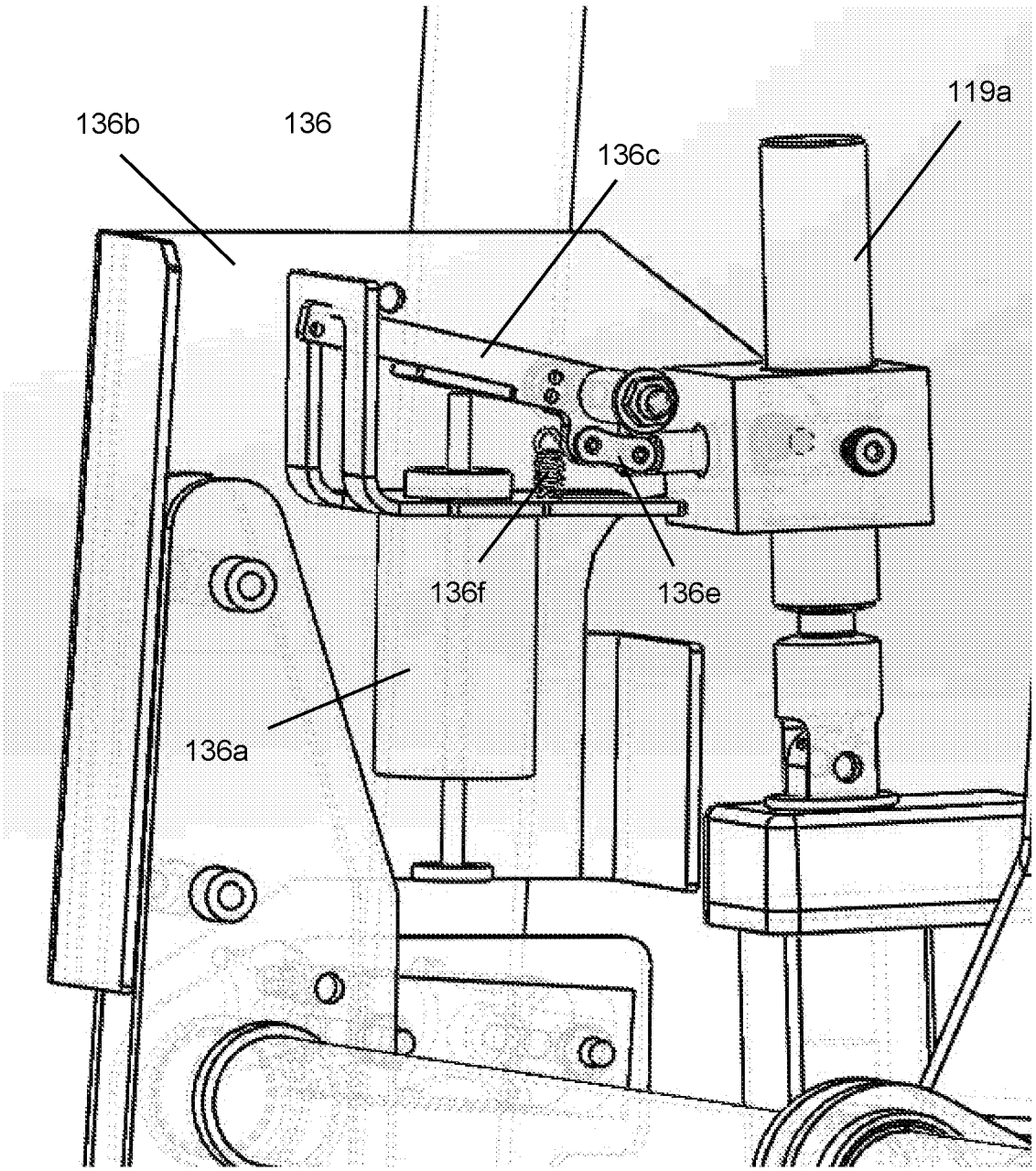
FIGS. 20 and 21 are views of the mode setting device when the screeding machine is set to the float mode.
Figure 21:
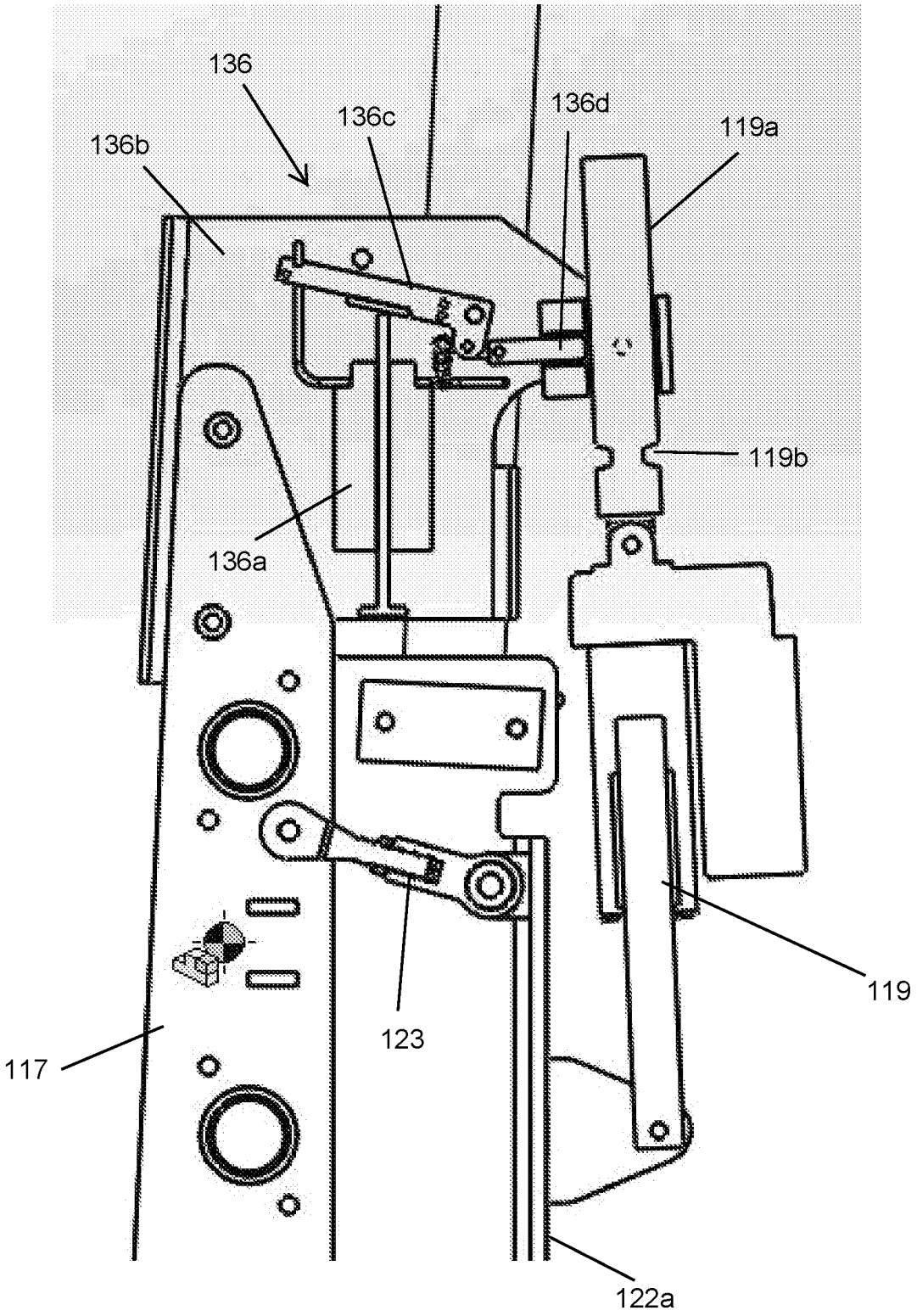

The screeding head 116 includes a frame portion 117 at each end region, with the frame portion extending upward and having a pair of cylindrical supports 132 attached at upper regions of the frame portions 117. The actuators 119 operate to adjust a bracket 122*a* of the grade setting device 122 relative to the frame portions 117. In the illustrated example, the brackets 122*a* are mounted at the frame portions 117 via pivoting links 123 and are raised and lowered to adjust the grade setting member responsive to signals from the laser receivers. As best shown in FIGS. 18 and 19, when the screeding machine is operating in the sensor control mode, extension and retraction of the actuators 119 operate to adjust the bracket 122*a* (and thus the grade setting device 122) relative to the frame portion 117 (and thus the vibrating member and laser receivers).

The screeding head 116 is supported at a support structure 130 of the support mechanism 114 via the pair of cylindrical supports 132 extending laterally across or through part of the support structure. The cylindrical supports 132 are adjustably or laterally-movably attached at the support structure 130 of the support mechanism 114 that is adjustably or pivotally attached at the end of the base portion 112*b* of the base unit 112 (at a frame portion 112*c* and at the adjustable link 138). In the illustrated embodiment, the support structure 130 includes upper and lower couplers or sleeves or bushings 134 that slidably engage the cylindrical supports 132 so that the cylindrical supports (and screeding head) are supported at and laterally or horizontally movable with the cylindrical supports relative to the support structure. Although shown as cylindrical supports and cylindrical couplers, clearly the supports and couplers may otherwise comprise a non-cylindrical cross sectional shape.

An additional cross support 140 may be attached at and span between the vertical posts or masts for the laser receivers to maintain the spacing between the laser receivers during operation of the screeding machine and when the lateral actuator is actuated to laterally adjust the screed head. The cross support may be adjustable in length to accommodate and to be used on different sized screed heads.

The lateral actuator 120 of the support mechanism 114 is oriented generally parallel to or along the cylindrical supports, with one end of the actuator attached at the support structure 130 of the support mechanism 114 and the other end of the actuator attached at one of the frame portions 117 of the screed head 116. Thus, extension and retraction of the lateral actuator 120 causes lateral movement of frame portion (and the cylindrical supports and the screeding head and the elevation actuators) relative to the support structure 130 (and the base unit).

The lateral actuator 120 may comprise a double ended hydraulic cylinder that is extendable via pressurized fluid at one end and is retractable via pressurized fluid at the other end. The lateral actuator may comprise a pressure relief valve (or other means to control pressure or force) that allows pressure to escape so that the cylindrical supports can be moved in a direction opposite the direction it is being urged by the lateral actuator. Thus, if the path of travel of the base unit moves toward the wall or structure, the screeding head position relative to the base unit adjusts (such as when the pressure in the actuator exceeds a threshold pressure) to avoid forcing the screeding head further into the wall or structure. Extension of the lateral actuator (beyond a centered or initial position or state) may move the screeding head toward one side of the base unit for screeding along a wall or structure at that side, and retraction of the lateral actuator (beyond the centered or initial position or state) may move the screeding head toward the other side of the base unit for screeding along a wall or structure at that side.

The screeding machine 110 may operate to screed the edges of a concrete slab or surface over the form boards (that are disposed along a wall or structure of the support surface) or over an existing slab, or the screeding machine may operate to screed the edges of newly placed uncured concrete that is forming a slab that is adjacent to a wall or structure at a support surface. The screeding machine 110 includes a mode adjustment or mode setting device or system 136 that is operable to adjust the operating mode when the screed head is moved from screeding concrete at a location where there are no frames or forms present to a location where a frame or form is at one or both of the ends of the screed head. For example, when the screed head 116 is screeding concrete where no forms are present, the system may operate in a sensor control mode, where the screed head is raised and lowered responsive to signals from elevation sensors 118*a* (e.g., laser receivers) disposed at respective posts 118 to maintain the screeding head 116 at the desired or appropriate or set grade. When the screeding head 116 is moved to a location where forms or frames are present, the machine can switch to a float mode where the sensor control is turned off and the screed is allowed to float or rest on the forms or frames as the screed head is moved along to screed the concrete.

During operation, the screeding machine may operate to screed concrete at locations where no frames or forms are present and where a frame or form is present. The mode adjustment or mode setting device or system 136 is operable to adjust the operating mode when the screed head is moved from screeding concrete at the location where there are no frames or forms present to the location where a frame or form is at one or both of the ends of the screed head. The mode setting device 136 operates to lock (or unlock) an upper end or rod 119*a* of the actuator 119. When the rod 119*a* is engaged by the mode setting device (i.e., when the machine is operating in the sensor control mode), operation of the actuator (responsive to signals from the laser receivers) operates to adjust the bracket 122*a* and the grade setting member relative to the vibrating member, and when the rod 119*a* is disengaged by the mode setting device (i.e., when the machine is operating in the float mode), operation of the actuator 119 does not adjust the grade setting member relative to the vibrating member such that the screed head floats on the forms or frames at the concrete surface.

In the illustrated embodiment, the mode setting device 136 comprises an actuator or solenoid 136*a* that is selectively operable to switch the mode setting device between the laser control mode and the float mode. The mode setting device includes a housing 136*b* (attached at the frame portion 117) that houses the actuator 136*a*, which engages a lever 136*c* that is pivotally attached at the housing and that is pivotally connected to an engaging pin 136*d* via a pivot linkage 136*e*. The rod 119*a* of the actuator 119 includes a notch or recess or groove 119*b* that is configured to receive the engaging pin 136*d* when the laser control mode is selected. The lever 136*c* is pivotally mounted at the housing and is biased toward a lower position via a biasing element or spring 136*f*, which urges the lever downward when the solenoid or actuator 136*a* is off.

Thus, when the laser control mode is selected, the actuator 136*a* is deactivated (such as via selection of the laser control mode by the operator of the machine at the control panel of the machine) and the lever 136*c* pivots to its lowered position (see FIGS. 17-19), such as via the biasing force or spring force of the spring 136*f*, which causes the pivot linkage 136*e* to move the engaging pin 136*d* toward the actuator rod 119*a*, whereby the pin 136*d* will insert into or be received into the recess or groove 119*b* when the rod is moved (such as via actuation of the actuator 119) into a position where the recess is aligned with the engaging pin. With the pin 136*d* engaged in the recess, extension and retraction of the actuator 119 will cause the lower end of the actuator and the bracket 122*a* to move upward or downward relative to the housing 136*b* and the frame portion 117 to adjust the grade setting member relative to the vibrating member.

Similarly, when the float mode is selected, the actuator or solenoid 136*a* is activated (such as via selection of the float mode by the operator of the machine at the control panel of the machine), whereby the solenoid pushes the lever 136*c* upward (see FIGS. 20 and 21), which pivots the lever and pulls at the pivot linkage 136*e* and moves the pivot linkage 136*e* and the engaging pin 136*d* away from the actuator rod 119*a* to disengage the engaging pin 136*d* from the groove 119*b*. With the engaging pin disengaged from the groove, the rod is free to move relative to the housing 136*b* and the frame portion 117, such that the plow lowers (via gravity) until it rests on the form or concrete. With the rod free to move relative to the housing, actuation of the actuator 119 (such as responsive to signals from the laser receivers) does not adjust the grade setting member relative to the vibrating member.

Thus, the screeding machine, when operating in the laser control mode, has the actuator rod 119*a* fixed relative to the housing 136*b* and the frame portion 117, such that extension and retraction of the actuator 119 (responsive to signals from the laser receivers) adjusts the grade setting member relative to the vibrating member to adjust the screed head level at the concrete surface. When the screeding machine is operating in the float mode, the actuator rod moves relative to the housing 136*b* and the frame portion, such that extension and retraction of the actuator 119 (responsive to signals from the laser receivers) does not adjust the grade setting member relative to the vibrating member so that the grade setting member and the vibrating member rest or float on the forms at the concrete. The multi-mode (laser control mode and float mode) screeding machine may include the laterally adjustable screed head (as illustrated and as discussed above), or may have the screed head non-laterally adjustably supported at the end of the base unit, such as via non-extending or shifting cross supports that attach at the base unit support structure and at the brackets of the screed head.

Therefore, the system or machine or method for screeding uncured concrete includes a screeding machine comprising a screed head assembly, a laterally adjustable support mechanism, a pair of elevation actuators and sensors disposed at opposite sides of the screed head assembly, and a controller or control system. The screed head assembly is moved over the concrete surface via the screeding machine to screed the concrete surface. The elevation sensors or laser receivers sense an elevation of the respective side or end portion of the screed head assembly relative to a laser-generated reference plane established above support surface, and the elevation cylinders operate to adjust the height of the screed head responsive to the laser signal received by the laser receivers to screed the concrete at the appropriate grade. The screeding machine may operate in a non-wall hugging mode, where the lateral actuator is at a centered or non-actuated state, and may operate in a wall hugging mode, where the lateral actuator is actuated to laterally shift or urge the screeding head toward the wall or structure alongside which the screeding machine travels during the screed pass.

During operation of the screeding machine, the screeding machine is maneuvered to be near the wall or structure, and the lateral actuator is actuated (such as via selection by an operator of the wall/structure hugging mode) to urge the screed head toward and to the wall or structure, and the screed head may be urged against the wall or structure by the lateral actuator. The lateral actuator may extend (or retract) until the screed head contacts the wall or structure and the pressure within the actuator reaches a threshold pressure. The lateral actuator allows for compression (or retraction or adjustment in the direction away from the wall or structure) if the screeding machine moves toward the wall or structure and may extend (via pressurization when the pressure within the actuator falls below the threshold pressure) to maintain the screed head at the wall or structure if the screeding machine moves away from wall or structure during the screed pass. The lateral actuator or hydraulic cylinder may be lightly pressurized to allow for urging the screed head laterally outward, and may have a pressure relief valve (or other pressure controlling means) that allows for retraction or compression when the pressure/force at the end of the actuator (due to the screeding machine moving toward the wall or structure and causing greater pressure between the screed head and the wall or structure) exceeds a threshold pressure.

The screeding machine is operable to screed the edges over form boards or over an existing slab. The screeding machine screeds the edges as close to the wall or structure (that protrudes upward above the desired concrete grade or elevation) as possible and maintains the screed head at or near or against the wall or structure as the machine moves along the screeding pass alongside the wall or structure. The screeding machine may screed the concrete at or near or against a wall or other structure, such as a column or the like. The vibrating member may operate to screed (via operation of a vibrating motor or element disposed at the vibrating member) the concrete surface or the screeding machine may be used as a "power rake" (such as by utilizing aspects of the machines described in U.S. Pat. No. 7,854,565, which is hereby incorporated herein by reference in its entirety). The screeding machine may be suitable for use on sidewalk and driveway applications, or other applications where matching to the forms along one or both sides is desired.

Changes and modifications to the specifically described embodiments can be carried out without departing from the principles of the present invention, which is intended to be limited only by the scope of the appended claims as interpreted according to the principles of patent law.

The invention claimed is:

1. A screeding machine for screeding uncured concrete, the screeding machine comprising:

a base unit;

a support mechanism disposed at an end portion of the base unit;

a screed head assembly supported at the support mechanism, wherein the screed head assembly comprises (i) a grade establishing member and (ii) a vibrating member;

wherein the support mechanism comprises a lateral actuator that operates to laterally shift the screed head assembly relative to the base unit in a direction orthogonal to a longitudinal axis of the base unit;

a control system, wherein the control system is operable to control the lateral actuator to laterally shift the screed head assembly in the direction orthogonal to the longitudinal axis of the base unit;

wherein the control system is operable to control a mode adjusting device to set the screeding machine in one of (i) a sensor control mode where the screed head assembly is adjusted responsive to an elevation sensor and (ii) a float mode where the vibrating member and grade establishing member float on the concrete or forms at the concrete; and wherein, when the screeding machine is operating in the sensor control mode, the grade establishing member is adjusted relative to the vibrating member via an elevation actuator that operates responsive to the elevation sensor.

2. The screeding machine of claim 1, wherein the screed head assembly is positionable at a screeding location adjacent to a wall or structure and is movable over the uncured concrete in a screeding direction via movement of the base unit along the uncured concrete and alongside the wall or structure, and wherein the screeding direction is parallel to the longitudinal axis of the base unit.

3. The screeding machine of claim 2, wherein the control system operates to control the lateral actuator to urge the screed head assembly laterally toward the wall or structure at a starting location of a screeding pass of the screeding machine.

4. The screeding machine of claim 3, wherein the lateral actuator maintains the screed head assembly at the wall or structure as the base unit moves along the uncured concrete and alongside the wall or structure.

5. The screeding machine of claim 4, wherein the lateral actuator maintains the screed head assembly at the wall or structure irrespective of lateral movement of the base unit toward or away from the wall or structure as the base unit moves along the uncured concrete and alongside the wall or structure.

6. The screeding machine of claim 3, wherein the lateral actuator operates responsive to the control system determining presence of the wall or structure at the screed head assembly.

7. The screeding machine of claim 6, wherein the control system determines presence of the wall or structure via a sensor that generates an output indicative of presence of the wall or structure at the screed head assembly.

8. The screeding machine of claim 1, wherein the control system is operable to control the lateral actuator responsive to an operating mode selection by an operator of the screeding machine.

9. The screeding machine of claim 1, wherein the base unit of the screeding machine comprises a wheeled base unit.

10. The screeding machine of claim 1, wherein the screed head assembly is supported at the support mechanism via an elevation actuator, and wherein the elevation actuator operates to adjust elevation of the screed head assembly responsive at least in part to the elevation sensor that senses elevation of the screed head assembly, and wherein the control system, responsive to the elevation sensor, controls the elevation actuator to set the grade of the uncured concrete.

11. The screeding machine of claim 10, wherein the elevation actuator comprises a pair of elevation actuators, with a respective elevation actuator disposed at a respective end region of the screed head assembly, and wherein each elevation actuator is responsive at least in part to a respective elevation sensor.

12. The screeding machine of claim 11, wherein the elevation sensors comprise laser receivers disposed at respective elevation actuators for sensing an elevation of the respective end region of the screed head assembly relative to a laser generated reference plane.

13. The screeding machine of claim 1, wherein, when the screeding machine is operating in the sensor control mode, the mode adjusting device engages the elevation actuator so that extension and retraction of the elevation actuator raises and lowers the grade establishing member relative to the vibrating member.

14. The screeding machine of claim 13, wherein, when the screeding machine is operating in the float mode, the mode adjusting device disengages from the elevation actuator.

15. A screeding machine for screeding uncured concrete, the screeding machine comprising:

a base unit;

a support mechanism disposed at an end portion of the base unit;

a screed head assembly supported at the support mechanism, wherein the screed head assembly comprises (i) a grade establishing member and (ii) a vibrating member;

wherein the screed head assembly is supported at the support mechanism via an elevation actuator, and wherein the elevation actuator operates to adjust elevation of the screed head assembly responsive at least in part to an elevation sensor that senses elevation of the screed head assembly, and wherein, responsive to the elevation sensor, the elevation actuator is operated to set the grade of the uncured concrete;

a mode adjusting device that operates to set the screeding machine in one of (i) a sensor control mode, where the screed head assembly is adjusted via the elevation actuator and responsive to the elevation sensor and (ii) a float mode where the vibrating member and grade establishing member float on the concrete or forms at the concrete; and wherein, when the screeding machine is operating in the sensor control mode, the grade establishing member is adjusted relative to the vibrating member via an elevation actuator that operates responsive to the elevation sensor.

16. The screeding machine of claim 15, wherein, when the screeding machine is operating in the sensor control mode, the mode adjusting device engages the elevation actuator so that extension and retraction of the elevation actuator raises and lowers the grade establishing member relative to the vibrating member.

17. The screeding machine of claim 16, wherein, when the screeding machine is operating in the float mode, the mode adjusting device disengages from the elevation actuator.

18. The screeding machine of claim 15, wherein the support mechanism comprises a lateral actuator that operates to laterally shift the screed head assembly relative to the base unit in a direction orthogonal to a screeding direction.

19. The screeding machine of claim 18, wherein the lateral actuator, when operated, urges the screed head assembly laterally toward a wall or structure along which the screeding machine moves while screeding the uncured concrete.

20. A method for screeding uncured concrete, the method comprising:

providing a screeding machine having a base unit and a screed head assembly, wherein the screed head assembly comprises (i) a grade establishing member and (ii) a vibrating member;

moving the screeding machine in a screeding direction along the uncured concrete while the screed head assembly screeds the uncured concrete; and laterally adjusting the screed head assembly relative to the base unit in a direction orthogonal to the screeding direction to laterally shift the screed head assembly toward a wall or structure along which the screeding machine moves while screeding the uncured concrete;

wherein an elevation actuator operates to adjust elevation of the screed head assembly responsive at least in part to an elevation sensor that senses elevation of the screed head assembly, and wherein, responsive to the elevation sensor, the elevation actuator is controlled to set the grade of the uncured concrete;

selectively operating the screeding machine in one of (i) a sensor control mode where the screed head assembly is adjusted via the elevation actuator responsive to the elevation sensor and (ii) a float mode where the vibrating member and grade establishing member float on the concrete or forms at the concrete;

wherein, when the screeding machine is operating in the sensor control mode, a mode adjusting device engages the elevation actuator so that extension and retraction of the elevation actuator raises and lowers the grade establishing member relative to the vibrating member; and wherein, when the screeding machine is operating in the float mode, the mode adjusting device disengages from the elevation actuator.

21. The method of claim 20, wherein laterally adjusting the screed head assembly comprises laterally adjusting the screed head assembly to urge the screed head assembly laterally toward the wall or structure at a starting location of a screeding pass of the screeding machine.

22. The method of claim 21, wherein laterally adjusting the screed head assembly includes maintaining the screed head assembly at the wall or structure as the base unit moves along the uncured concrete and alongside the wall or structure.

23. The method of claim 22, wherein the screed head assembly is maintained at the wall or structure irrespective of lateral movement of the base unit toward or away from the wall or structure as the base unit moves along the uncured concrete and alongside the wall or structure.

24. The method of claim 21, wherein laterally adjusting the screed head assembly toward a wall or structure is responsive to determining presence of the wall or structure at the screed head assembly.

25. The method of claim 24, wherein presence of the wall or structure is determined via a sensor that generates an output indicative of presence of the wall or structure at the screed head assembly.

26. The method of claim 20, wherein laterally adjusting the screed head assembly toward a wall or structure is responsive to an operating mode selection by an operator of the screeding machine.

27. The method of claim 20, wherein the base unit of the screeding machine comprises a wheeled base unit.

* * * * *